US008777659B2

(12) United States Patent
Tajiri et al.

(10) Patent No.: US 8,777,659 B2
(45) Date of Patent: Jul. 15, 2014

(54) COAXIAL CABLE CONNECTION MODULE HAVING SIGNAL AND GROUNDING TERMINALS WITH FLAT CONTACT FACES AND ARRANGED ON TWO SIDES OF AN INSULATING BODY

(71) Applicant: Fujitsu Component Limited, Tokyo (JP)

(72) Inventors: Hiroshi Tajiri, Tokyo (JP); Koki Sato, Tokyo (JP); Mitsuru Kobayashi, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 49 days.

(21) Appl. No.: 13/682,204

(22) Filed: Nov. 20, 2012

(65) Prior Publication Data

US 2013/0130542 A1 May 23, 2013

(30) Foreign Application Priority Data

Nov. 21, 2011 (JP) ..... 2011-254126

(51) Int. Cl.
*H01R 9/05* (2006.01)

(52) U.S. Cl.
USPC ..... 439/578

(58) Field of Classification Search
CPC ..... H01R 9/05; H01R 9/0512; H01R 9/0515; H01R 9/0518; H01R 9/0521; H01R 9/0525; H01R 9/0524; H01R 9/257
See application file for complete search history.

(56) References Cited

U.S. PATENT DOCUMENTS

| | | | | |
|---|---|---|---|---|
| 4,898,545 | A * | 2/1990 | Endo et al. | 439/578 |
| 6,190,202 | B1 * | 2/2001 | Lai | 439/578 |
| 6,200,163 | B1 * | 3/2001 | O'Sullivan | 439/579 |
| 6,913,485 | B2 * | 7/2005 | Ko | 439/579 |

FOREIGN PATENT DOCUMENTS

| | | |
|---|---|---|
| JP | 2009-129863 | 6/2009 |
| JP | 2010-92677 | 4/2010 |

* cited by examiner

*Primary Examiner* — Chandrika Prasad
(74) *Attorney, Agent, or Firm* — Staas & Halsey LLP

(57) ABSTRACT

A coaxial cable connection module including a body; a first signal terminal including a first flat signal contact face; a first ground terminal including a first flat ground contact face; a second signal terminal including a second flat signal contact face; and a second ground terminal including a second flat ground contact face. The first signal contact face and the first ground contact face are arranged, on the first surface of the body, in parallel with each other with a predetermined pitch defined therebetween. The second signal contact face and the second ground contact face are arranged, on the second surface of the body opposite to the first surface, in parallel with each other with the predetermined pitch defined therebetween. The first signal contact face is located opposite to the second ground contact face. The first ground contact face is located opposite to the second signal contact face.

10 Claims, 21 Drawing Sheets

COAXIAL CABLE CONNECTION MODULE HAVING SIGNAL AND GROUNDING TERMINALS WITH FLAT CONTACT FACES AND ARRANGED ON TWO SIDES OF AN INSULATING BODY

CROSS-REFERENCE TO RELATED APPLICATIONS

This application is based upon and claims the benefit of priority of the prior Japanese Application No. 2011-254126, filed Nov. 21, 2011, the entire contents of which are incorporated herein by reference.

BACKGROUND OF THE INVENTION

1. Field of the Invention

The present invention relates to a coaxial cable connection module. The present invention further relates to a multipole connector for a coaxial cable, which includes a plurality of coaxial cable connection modules. The present invention still further relates to a multipole composite connector provided with a multipole connector for a coaxial cable and a connector for a non-coaxial cable integrally combined with the multipole connector.

2. Description of the Related Art

In connectors used for detachably connecting coaxial cables to counterparts, a connector applicable to a multipole configuration simultaneously connecting a plurality of coaxial cables to a connection counterpart, such as a circuit board, has been known.

For example, Japanese Unexamined Patent Publication (Kokai) No. 2010-092677 (JP2010-092677A) describes a coaxial connector including a terminal unit, wherein the terminal unit includes a signal terminal connected to a signal line of a coaxial cable, a ground terminal connected to a ground line of the coaxial cable, and an electrically insulating relay board previously formed integrally with the signal terminal. After the signal line of the coaxial cable is connected to the signal terminal, the ground terminal is attached to the relay board so as to cover the connected portion of the signal line and is connected to the ground line of the coaxial cable. The signal terminal and the ground terminal are respectively provided with a plate-like signal contact part and a plate-like ground contact part, adapted to respectively contact a counterpart signal terminal and a counterpart ground terminal. The signal contact part and the ground contact part are arranged alongside and parallel to each other. A plurality of terminal units, each connected to a single coaxial cable, are fitted to a single housing, so as to construct a coaxial multipole connector attached to the distal ends of a plurality of coaxial cables.

Japanese Unexamined Patent Publication (Kokai) No. 2009-129863 (JP2009-129863A) describes a multiple coaxial connector including a coaxial cable block, wherein the coaxial cable block includes a signal post connected to a center conductor of a coaxial cable, a GND post connected to an external conductor of the coaxial cable, and a resinous molded part to which the signal post is attached by insert molding and the GND post is fixed by caulking. The signal post and the GND post are respectively provided with terminal plate parts adapted to respectively contact elastically a counterpart signal contact and a counterpart GND contact. The terminal plate parts are arranged to face each other. A plurality of coaxial cable blocks, each connected to a single coaxial cable, are fitted to a single housing, so as to construct a multiple coaxial connector (or a plug) attached to the distal ends of a plurality of coaxial cables.

SUMMARY OF THE INVENTION

In a coaxial cable connector applicable to a multipole configuration, it is desired to prevent the high-frequency transmission characteristics of a coaxial cable from degrading, to prevent the dimensions of a multipole connector from increasing, and to increase the number of cables capable of being connected through the connector.

One aspect of the present invention provides a coaxial cable connection module comprising a body having electrical insulating properties, the body including a first surface and a second surface opposite to the first surface; a first signal terminal provided on the first surface and adapted to be connected to a signal line of a first coaxial cable, the first signal terminal including a first flat signal contact face adapted to contact a signal conductor of a connection counterpart; a first ground terminal provided on the first surface and adapted to be connected to a shield line of the first coaxial cable, the first ground terminal including a first flat ground contact face adapted to contact a ground conductor of a connection counterpart; a second signal terminal provided on the second surface and adapted to be connected to a signal line of a second coaxial cable, the second signal terminal including a second flat signal contact face adapted to contact a signal conductor of a connection counterpart; and a second ground terminal provided on the second surface and adapted to be connected to a shield line of the second coaxial cable, the second ground terminal including a second flat ground contact face adapted to contact a ground conductor of a connection counterpart; wherein the first signal contact face and the first ground contact face are arranged, on the first surface, in parallel with each other with a predetermined pitch defined therebetween; wherein the second signal contact face and the second ground contact face are arranged, on the second surface, in parallel with each other with the predetermined pitch defined therebetween; wherein the first signal contact face is located opposite to the second ground contact face, and the first ground contact face is located opposite to the second signal contact face.

Another aspect of the present invention provides a multipole connector for a coaxial cable, the multipole connector comprising a plurality of coaxial cable connection modules, each of which is the coaxial cable connection module of the above aspect; and a housing receiving and supporting the plurality of coaxial cable connection modules in a parallel arrangement.

A further aspect of the present invention provides a multipole composite connector comprising the multipole connector of the above other aspect; and a connector for a non-coaxial cable combined with the multipole connector in a unitary manner.

DESCRIPTION OF THE EMBODIMENT

Figure 1:
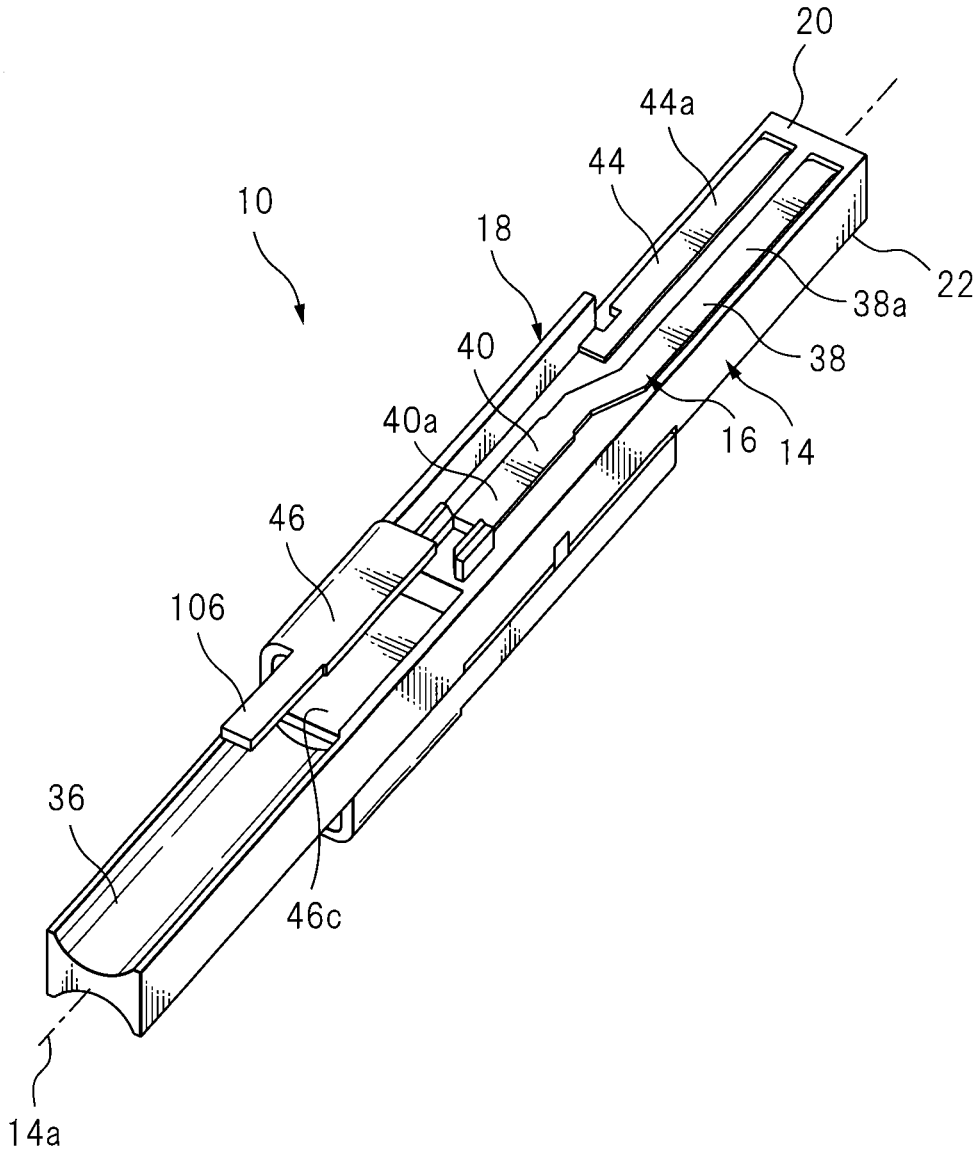
FIG. 1 is a perspective view depicting a coaxial cable connection module according to one embodiment of the present invention.

The embodiments of the present invention are described below, in detail, with reference to the accompanying drawings. In the drawings, the same or similar components are denoted by common reference numerals.

In the following description, the terms expressing directions, such as "front", "back", "right", "left", "top", "bottom", "vertical", "horizontal", etc., are used merely for descriptive purposes to provide a better understanding, and do not intend to define any directional limitation when, e.g., actually used.

Figure 2:
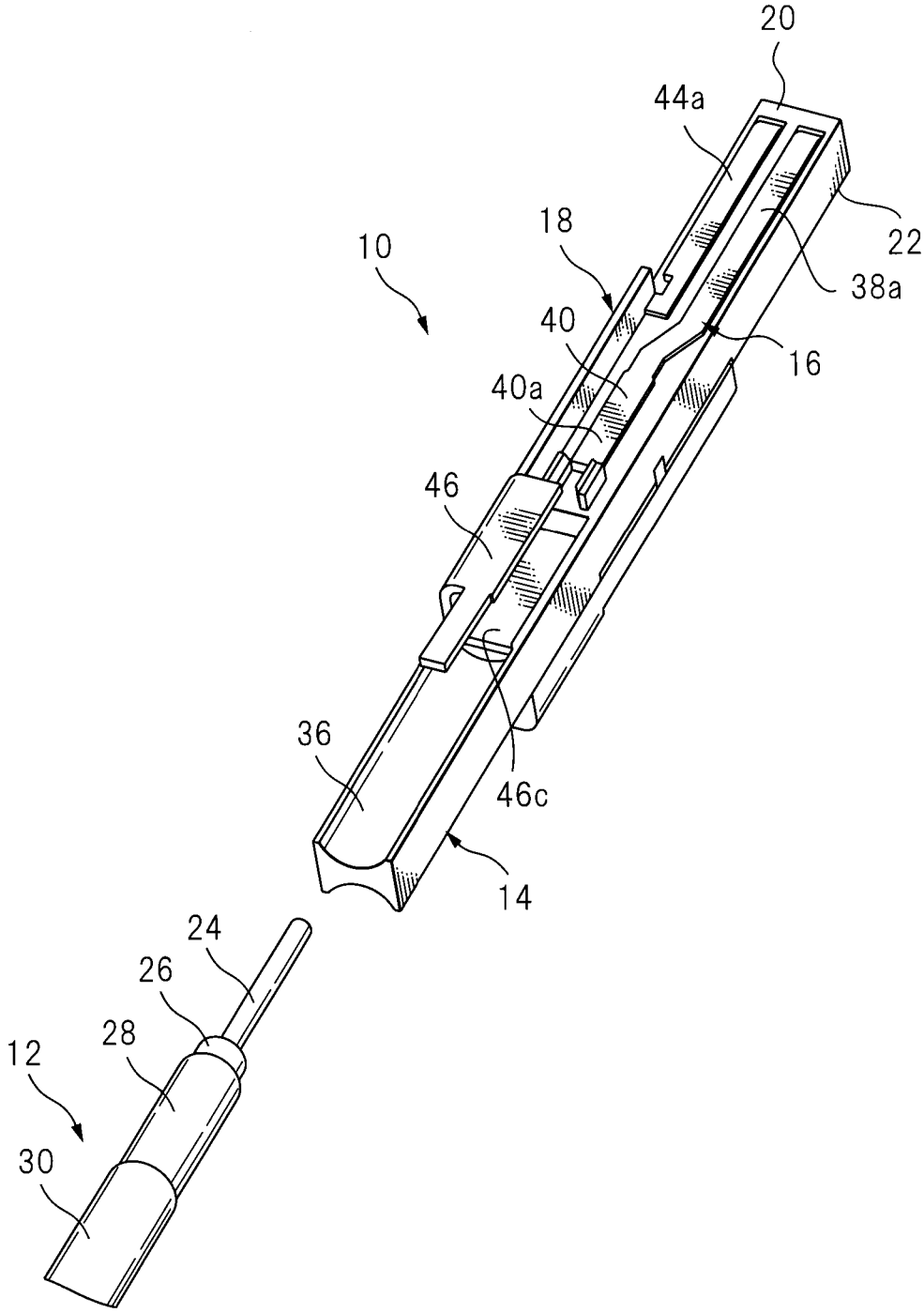
FIG. 2 is a perspective view depicting the coaxial cable connection module of FIG. 1, together with a coaxial cable.
Figure 8A:
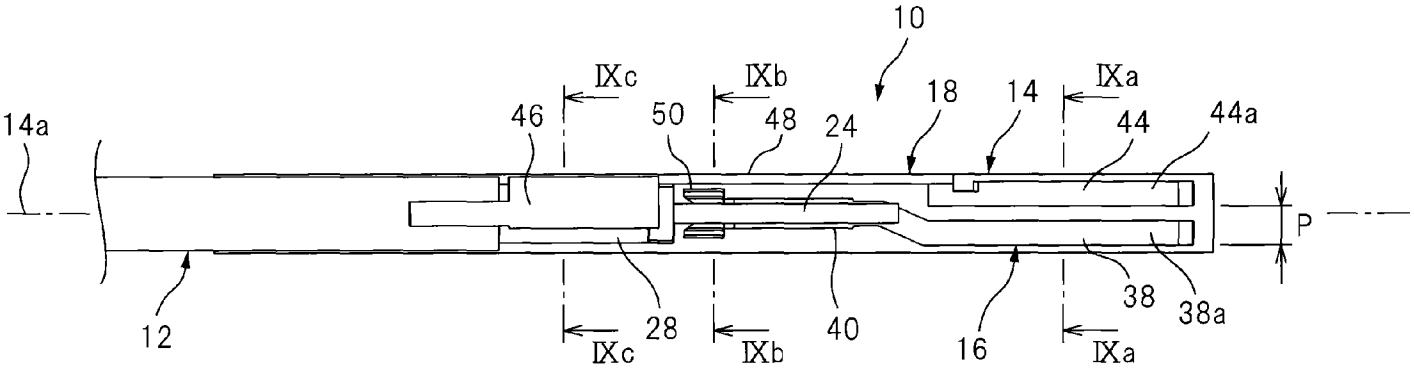
FIG. 8A is a plan view depicting the coaxial cable connection module of FIG. 1, attached to a coaxial cable.
Figure 8B:
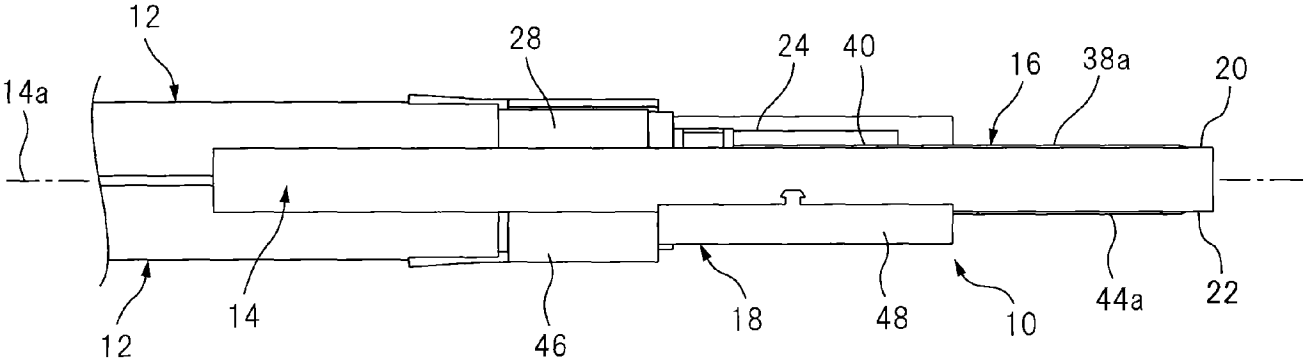
FIG. 8B is a side view depicting the coaxial cable connection module of FIG. 8A.
Figure 9C:
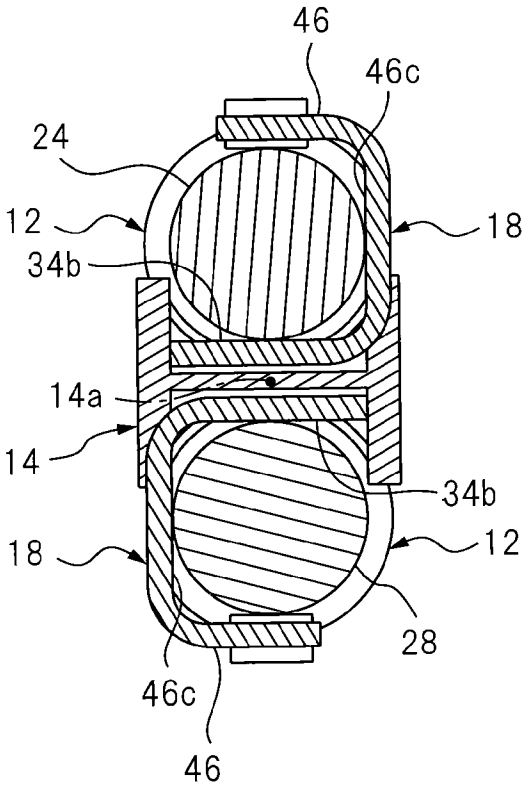
FIG. 9C is a sectional view taken along a line IXc-IXc of FIG. 8A.
Figure 9B:
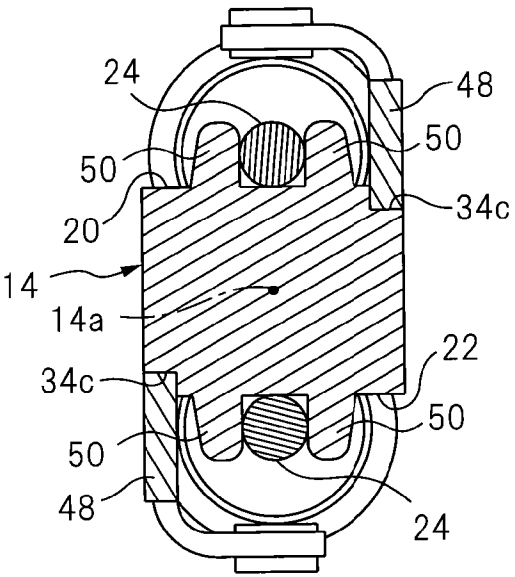
FIG. 9B is a sectional view taken along a line IXb-IXb of FIG. 8A.
Figure 9A:
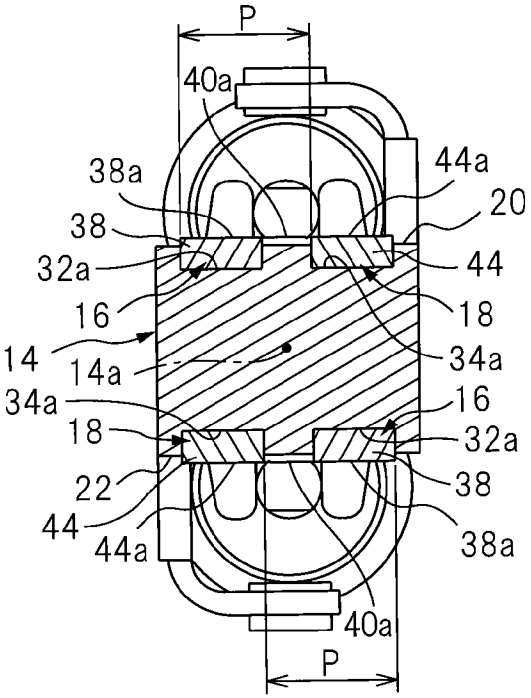
FIG. 9A is a sectional view taken along a line IXa-IXa of FIG. 8A, depicting the coaxial cable connection module attached to a coaxial cable.

Referring to the drawings, FIG. 1 is a perspective view depicting a coaxial cable connection module 10 according to a first embodiment (hereinafter referred simply to as "module 10") in an assembled state; FIG. 2 is a perspective view depicting the module 10 together with an objective coaxial cable 12; FIGS. 3A-5B are perspective views depicting components of the module 10; and FIG. 6 is an exploded perspective view depicting the module 10 together with the coaxial cable 12. FIGS. 7-9C depict the module 10 attached to first and second coaxial cables 12, in which FIG. 8A is a plan view; FIG. 8B is a side view; FIG. 9A is a sectional view taken along a line IXa-IXa of FIG. 8A; FIG. 9B is a sectional view taken along a line IXb-IXb of FIG. 8A; and FIG. 9C is a sectional view taken along a line IXc-IXc of FIG. 8A.

As depicted in FIG. 1, the module 10 includes a body 14 having electrical insulating properties, a signal terminal 16 attached to the body 14 and capable of being connected to a signal line of the coaxial cable 12, and a ground terminal 18 attached to the body 14 and capable of being connected to a shield line of the coaxial cable 12. The body 14 includes a first surface 20 and a second surface 22 opposite to the first surface 20. The module 10 is provided, on each of the first and second surfaces 20, 22 of the body 14, with a terminal pair including a single signal terminal 16 and a single ground terminal 18. The module 10 is configured so as to enable first and second coaxial cables 12 having mutually identical structures and arranged on the first and second surfaces 20, 22 to be collectively connected to a connection counterpart (not depicted).

Each of the first and second coaxial cables 12 is provided with a signal line (i.e., an internal conductor) 24, a tubular insulator 26 enveloping the signal line 24, a shield line (i.e., an external conductor) 28 formed from a braid, a stranded wire, a foil, etc., and disposed outside the insulator 26 across the entire circumference thereof, and a tubular insulating sheath 30 enveloping the shield line 28. The coaxial cable 12 thus configured has properties such as to be insulated from the influence of extrinsic noise, since the shield line 28 is disposed outside the signal line 24 across the entire circumference thereof, and thus is frequently used for various electric and electronic equipment, such as communication equipment, information equipment, medical equipment, measurement equipment, etc. When the module 10 is attached to the coaxial cable 12, a terminal treatment is performed on a predetermined length of the coaxial cable 12 adjacent to the distal end thereof, in which the insulating sheath 30, the shield line 28 and the insulator 26 are removed in this order and thereby the shield line 28, the insulator 26 and the signal line 24 are locally exposed in a stepwise fashion (FIG. 2).

The body 14 of the module 10 is a bar member having a substantially rectangular parallelepiped shape and molded into a unitary piece from an electrical insulating resinous material through, e.g., an injection molding process. The first surface 20 and the second surface 22 are formed at locations rotationally symmetrical through 180 degrees with respect to each other about a center axis 14*a* (FIG. 1) extending in the longitudinal direction of the body 14.

Figure 3A:
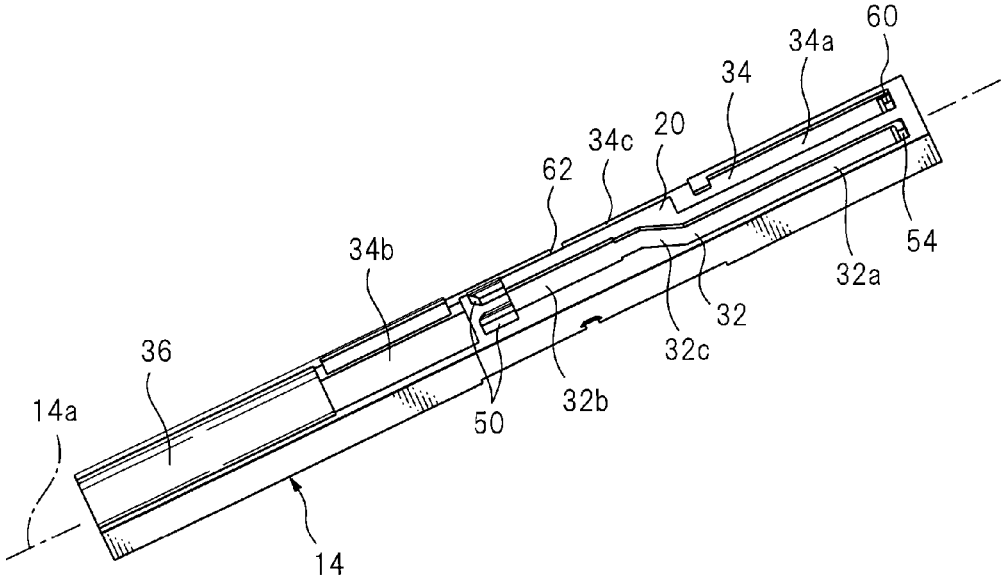
FIG. 3A is a top perspective view depicting a body of the coaxial cable connection module of FIG. 1.
Figure 3B:
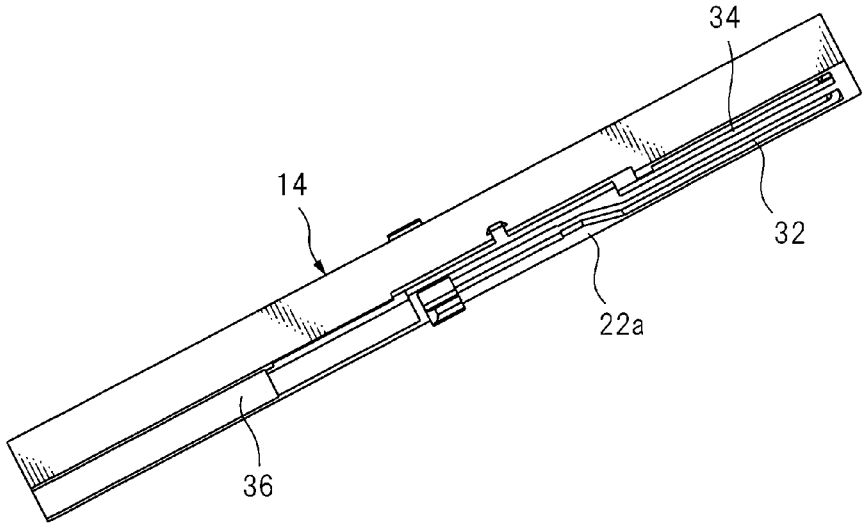
FIG. 3B is a bottom perspective view depicting the body of FIG. 3A.

FIG. 3A is a top perspective view depicting the body 14, and FIG. 3B is a bottom perspective view depicting the body 14. On the first surface 20, a first signal terminal support section 32 for supporting a single first signal terminal 16, a first ground terminal support section 34 for supporting a single first ground terminal 18, and a first cable support section 36 for supporting a portion of a single first coaxial cable 12 having the insulating sheath 30 (i.e., a sheathed portion), are provided. On the second surface 22, a second signal terminal support section 32 for supporting a single second signal terminal 16, a second ground terminal support section 34 for supporting a single second ground terminal 18, and a second cable support section 36 for supporting a portion of a single second coaxial cable 12 having the insulating sheath 30 (i.e., a sheathed portion), are provided.

Figure 7:
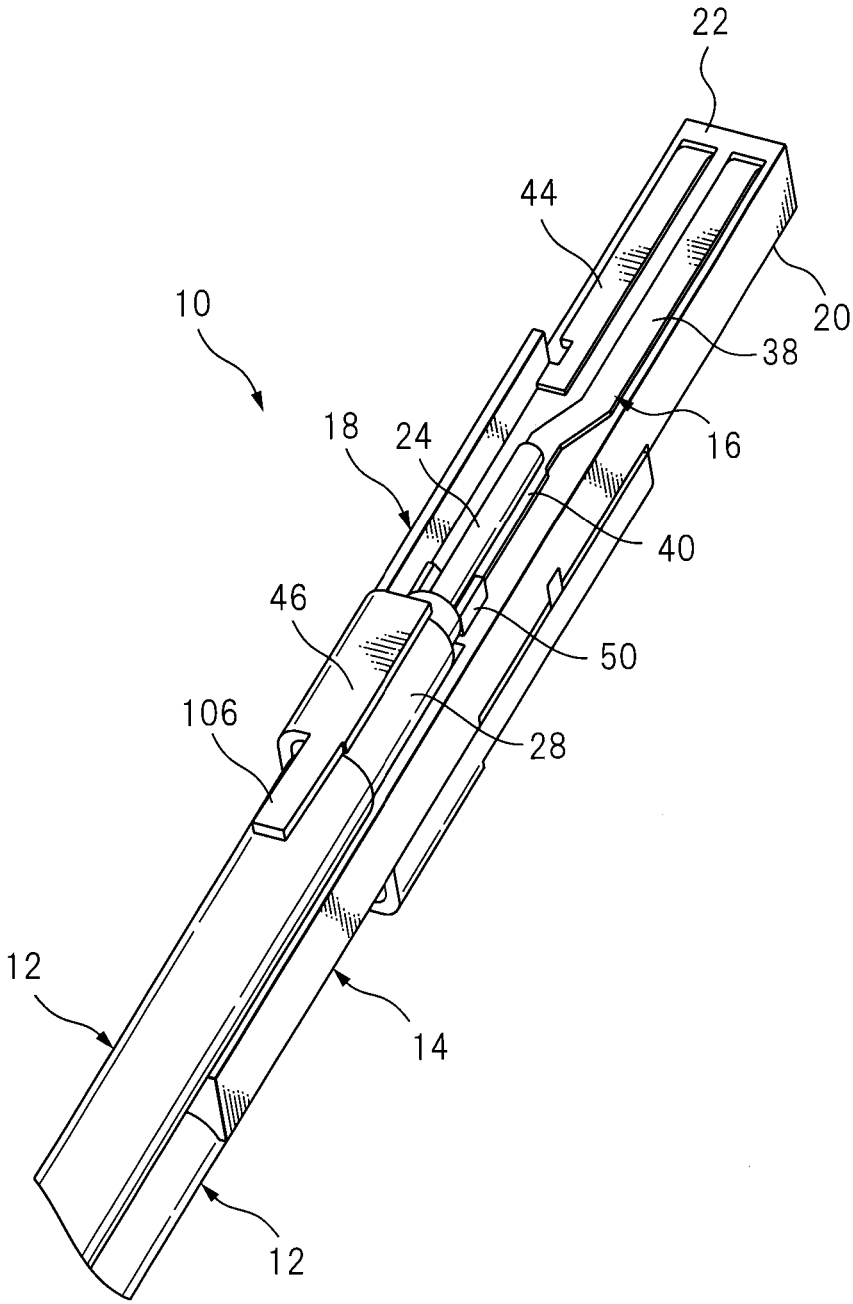
FIG. 7 is a perspective view depicting the configuration of a second surface side of a body of the coaxial cable connection module of FIG. 1, with a coaxial cable connected to the second surface side.

In the illustrated embodiment, the first and second surfaces 20, 22 of the body 14 have mutually identical configurations (FIGS. 1 and 7). Therefore, it should be considered that features depicted in the drawings in connection with the first surface 20 are the same as features in the second surface 22, unless otherwise particularly indicated.

Figure 4A:
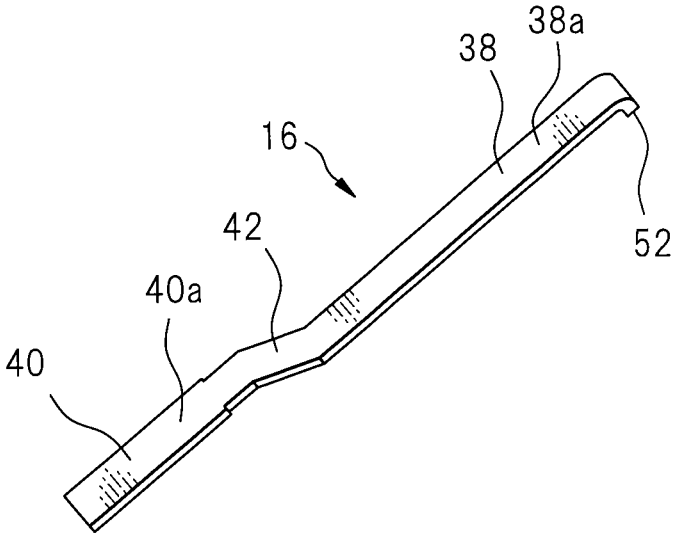
FIG. 4A is a top perspective view depicting a signal terminal of the coaxial cable connection module of FIG. 1.
Figure 4B:
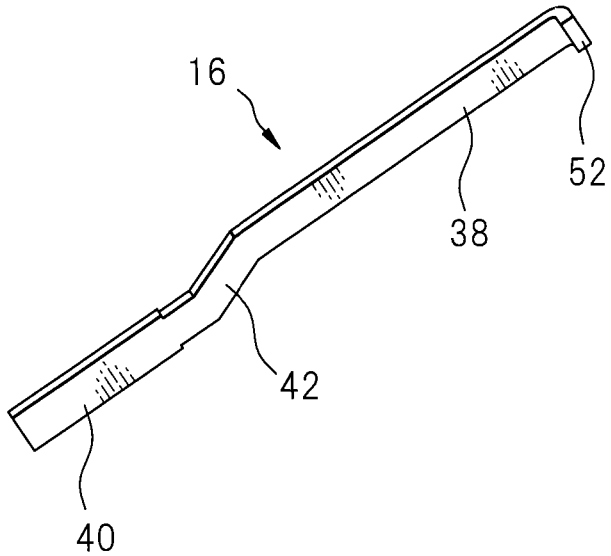
FIG. 4B is a bottom perspective view depicting the signal terminal of FIG. 4A.

FIG. 4A is a top perspective view depicting the signal terminal 16, and FIG. 4B is a bottom perspective view depicting the signal terminal 16. Each of the first and second signal terminals 16 is a pin-shaped element formed from a good electro-conductive sheet metal material through, e.g., a press forming process. Each signal terminal 16 includes, in an integral or unitary manner, a signal contact part 38 formed adjacent to one longitudinal end (a right end in FIG. 4A) and capable of contacting a signal conductor of a connection counterpart (not depicted), a signal line connection part 40 formed adjacent to the other longitudinal end (a left end in FIG. 4A) and capable of being connected to the signal line 24 of the coaxial cable 12, and an intermediate part 42 extending between the signal contact part 38 and the signal line connection part 40. The signal contact part 38 and the signal line connection part 40 extend in directions substantially parallel to each other along the longitudinal direction of the signal terminal 16. The intermediate part 42 extends so as to obliquely intersect the signal contact part 38 and the signal line connection part 40, so that the signal contact part 38 is not aligned with the signal line connection part 40 in a transverse direction.

A flat signal contact face 38*a* capable of contacting the signal conductor of the connection counterpart (not depicted) is formed on the signal contact part 38. The signal contact face 38*a* has a substantially rectangular strip-like profile as seen in a plan view. A flat joint face 40*a* capable of being joined to the signal line 24 of the coaxial cable 12 by soldering, etc., is formed on the signal line connection part 40. The signal terminal 16 has entirely a flat shape. The signal contact face 38*a* and the joint face 40*a* are disposed in a common virtual plane.

Figure 5A:
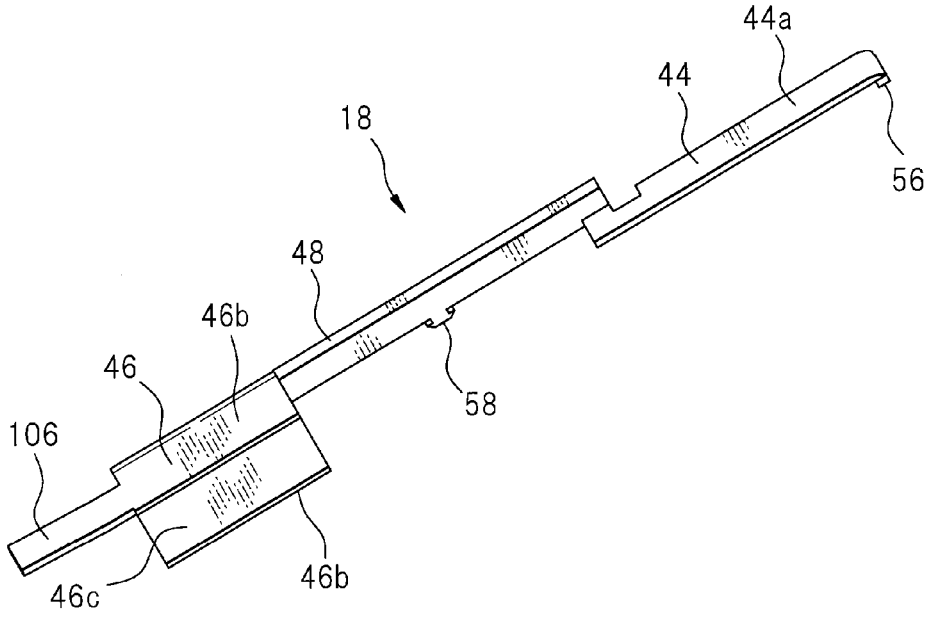
FIG. 5A is a top perspective view depicting a ground terminal of the coaxial cable connection module of FIG. 1.
Figure 5B:
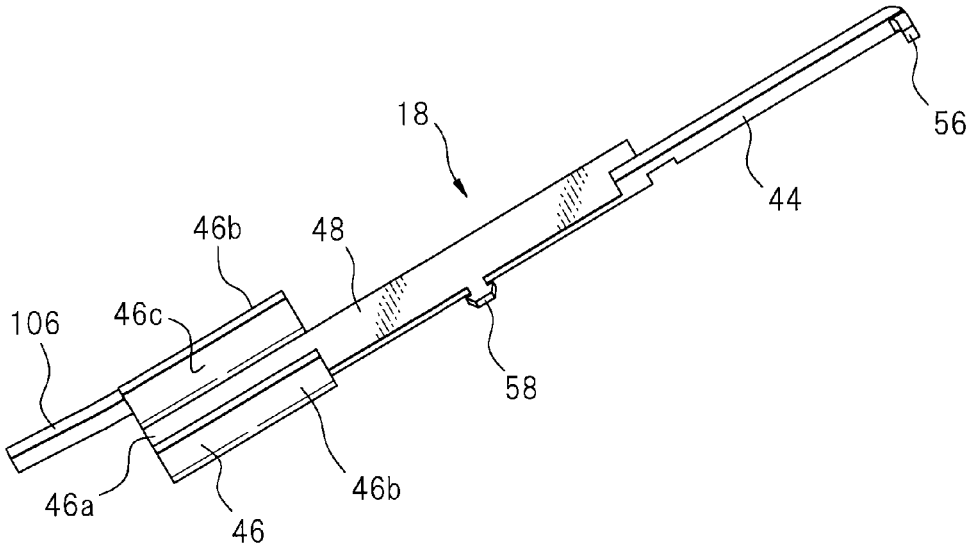
FIG. 5B is a bottom perspective view depicting the ground terminal of FIG. 5A.
Figure 6:
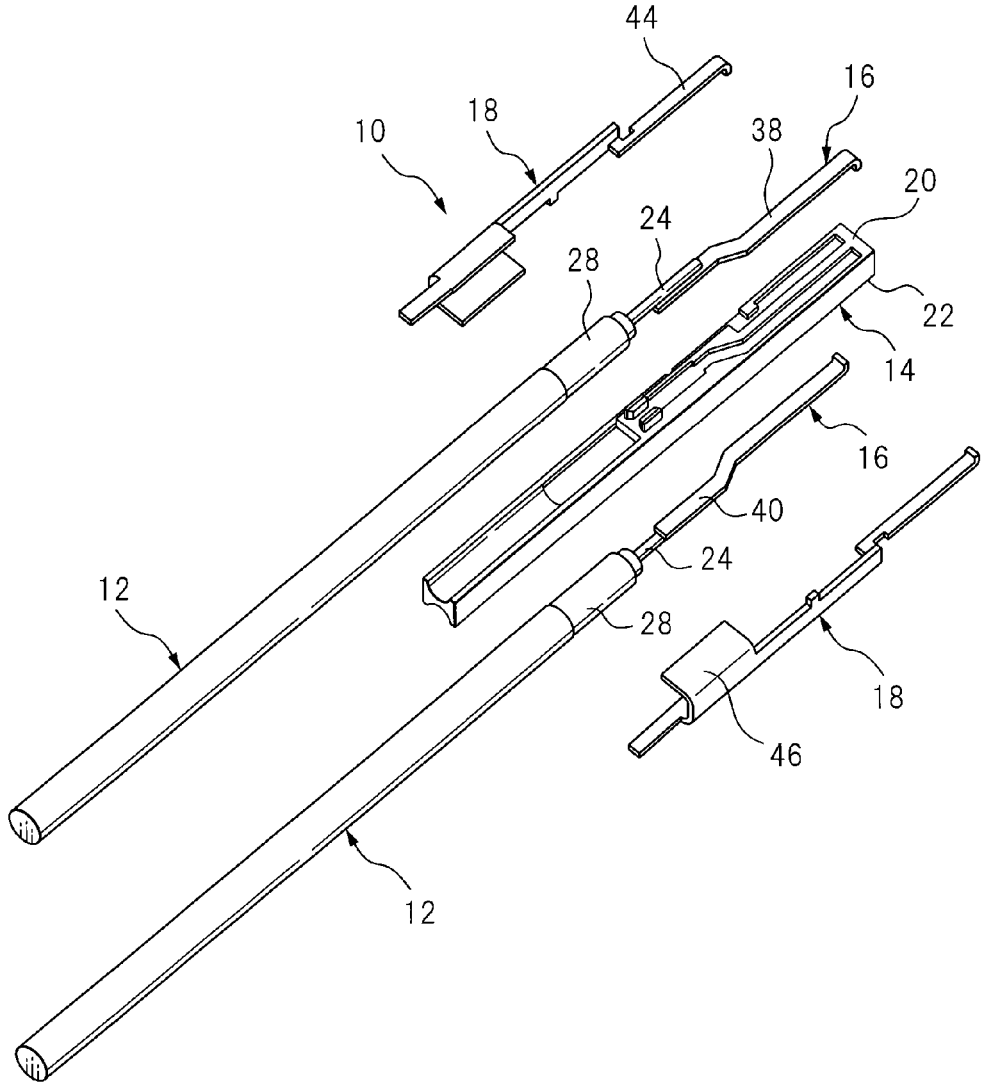
FIG. 6 is an exploded perspective view depicting the coaxial cable connection module of FIG. 1, together with a coaxial cable.

FIG. 5A is a top perspective view depicting the ground terminal 18, and FIG. 5B is a bottom perspective view depicting the ground terminal 18. Each of the first and second ground terminals 18 is a pin-shaped element formed from a good electro-conductive sheet metal material through, e.g., a press forming process. Each ground terminal 18 includes, in an integral or unitary manner, a ground contact part 44 formed adjacent to one longitudinal end (a right end in FIG. 5A) and capable of contacting a ground conductor of a connection counterpart (not depicted), a shield line connection part 46 formed adjacent to the other longitudinal end (a left end in FIG. 5A) and capable of being connected to the shield line 28 of the coaxial cable 12, and an intermediate part 48 extending between the ground contact part 44 and the shield line connection part 46. The ground contact part 44, the shield line connection part 46 and the intermediate part 48 extend in directions substantially parallel to each other along the longitudinal direction of the ground terminal 18.

The ground contact part 44 is formed adjacent to one end of the intermediate part 48 to be bent at a substantially right angle relative to the intermediate part 48. A flat ground contact face 44*a* capable of contacting the ground conductor of the connection counterpart (not depicted) is formed on the ground contact part 44. The ground contact face 44*a* has a substantially rectangular strip-like profile, as seen in a plan view, substantially identical to the profile of the signal contact face 38*a*. The shield line connection part 46 includes a center part 46*a* formed adjacent to the other end of the intermediate part 48 and extending straight from the intermediate part 48, and a pair of wing parts 46*b* each formed to be bent at a substantially right angle relative to the center part 46*a*. A U-shaped joint face 46*c* capable of surrounding the shield line 28 of the coaxial cable 12 from three sides and being joined to the shield line 28 by soldering, etc., is formed on the shield line connection part 46 at the inside of the center and wing parts 46*a*, 46*b* (FIG. 9C).

As depicted in FIGS. 3A and 3B, each of the first and second signal terminal support sections 32 of the body 14 is formed as a groove recessed from each surface 20, 22 to a uniform depth nearly equal to the material thickness of the signal terminal 16, and includes regions 32*a*, 32*b* and 32*c* having shapes and dimensions enabling the signal contact part 38, the signal line connection part 40 and the intermediate part 42 of the signal terminal 16 to be snugly received therein, respectively. The region 32*a* of the signal terminal support section 32 is provided near one longitudinal end of each surface 20, 22 (a right end in FIG. 3A) at a location deviated to one side from the center axis 14*a* (FIG. 9A). The region 32*b* of the signal terminal support section 32 is provided at the approximately center of each surface 20, 22 in longitudinal and transverse directions. The region 32*c* of the signal terminal support section 32 is provided at a location connecting the region 32*a* to the region 32*b*. In a state where the signal terminal 16 is attached to the signal terminal support section 32, the signal contact face 38*a* and the joint face 40*a* of the signal terminal 16 are located to be exposed at positions slightly projecting from each surface 20, 22 (FIG. 9A).

As depicted in FIGS. 3A and 3B, each of the first and second ground terminal support sections 34 of the body 14 is formed as a groove recessed from each surface 20, 22 to a predetermined depth, and includes regions 34*a*, 34*b* and 34*c* having shapes and dimensions enabling the ground contact part 44, the shield line connection part 46 and the intermediate part 48 of the ground terminal 18 to be snugly received therein, respectively. The regions 34*a* and 34*c* are recessed from the surface 20, 22 to a uniform depth nearly equal to the material thickness of the ground terminal 18. The region 34*b* is recessed to a depth further than the regions 34*a* and 34*c* by a predetermined dimension (e.g., a dimension equal to one half of a distance between the outermost surface of the shield line 28 and the outermost surface of the signal line 24 in the coaxial cable 12) (FIG. 9C). The region 34*a* of the ground terminal support section 34 is provided near one longitudinal end of each surface 20, 22 (a right end in FIG. 3A) at a location deviated from the center axis 14*a* to a side opposite to the region 32*a* of the signal terminal support section 32 (FIG. 9A). The region 34*b* of the ground terminal support section 34 is provided at the approximately center of each surface 20, 22 in longitudinal and transverse directions and closer to the other longitudinal end of each surface 20, 22 (a left end in FIG. 3A) than the region 32*b* of the signal terminal support section 32. The region 34*c* of the ground terminal support section 34 is provided along one lateral edge of each surface 20, 22 (FIG. 9B) at a location connecting the region 34*a* to the region 34*b*. In a state where the ground terminal 18 is attached to the ground terminal support section 34, the ground contact face 44*a* of the ground terminal 18 is located to be exposed at a position slightly projecting from each surface 20, 22 (FIG. 9A).

As depicted in FIGS. 3A and 3B, each of the first and second cable support sections 36 of the body 14 is formed as a groove recessed from each surface 20, 22 to a predetermined depth, and has a shape and a dimension enabling a portion of the coaxial cable 12 having the insulating sheath 30 (i.e., a sheathed portion) to be substantially snugly received therein. The cable support section 36 is recessed to a depth further than the region 34*b* of the ground terminal support section 34 by a predetermined dimension (e.g., a dimension generally equal to one half of a distance between the outermost surface of the insulating sheath 30 and the outermost surface of the shield line 28 in the coaxial cable 12), so as to have a semi-cylindrical surface corresponding to the cylindrical shape of the sheathed portion of the coaxial cable 12 (FIG. 1). The cable support section 36 is provided near the other longitudinal end of each surface 20, 22 (a left end in FIG. 1).

In a state where the signal terminal 16 and the ground terminal 18 are attached to each of the first and second surfaces 20, 22 of the body 14, the signal contact part 38 of the signal terminal 16 and the ground contact part 44 of the ground terminal 18 are arranged alongside and parallel to each other, and the signal contact face 38*a* and the ground contact face 44*a* are arranged, in a common virtual plane parallel to each surface 20, 22, in parallel with each other with a predetermined pitch P defined therebetween (FIGS. 8A and 9A). Further, on each surface 20, 22, the signal contact face 38*a* and the ground contact face 44*a* are arranged symmetrically with respect to a virtual plane extending perpendicular to each surface 20, 22 to pass through the center axis 14*a* (FIG. 9A). In this connection, the "pitch P" is defined as a shortest distance between mutually corresponding two points in the signal contact face 38*a* and the ground contact face 44*a*. In FIGS. 8A and 9A, the shortest distance between one side edge of the signal contact face 38*a* and the corresponding side edge of the ground contact face 44*a* is depicted as the pitch P.

In the above state, on each of the first and second surfaces 20, 22 of the body 14, the signal line connection part 40 of the signal terminal 16 and the shield line connection part 46 of the ground terminal 18 are substantially aligned with each other along the longitudinal direction of the signal terminal 16 and the ground terminal 18 (FIG. 8A). Further, on each surface 20, 22, the signal line connection part 40 of the signal terminal 16 and the intermediate part 48 of the ground terminal 18 are arranged mutually alongside in the transverse direction of the body 14, so that the intermediate part 48 is located so as not to interfere with the signal line connection part 40 located at the approximately center in the transverse direction (FIG. 8A). Since the signal terminal support section 32 and the ground terminal support section 34 are formed as grooves recessed from each surface 20, 22, the signal terminal 16 and the ground terminal 18 are insulated from each other on each surface 20, 22.

Further in the above state, on each of the first and second surfaces 20, 22 of the body 14, the signal line connection part 40 of the signal terminal 16 and the shield line connection part 46 of the ground terminal 18 are substantially aligned with respect to the cable support section 36, along the longitudinal direction of the signal terminal 16 and the ground terminal 18 (FIG. 1). According to this configuration, it is possible to attach the module 10 to the coaxial cable 12 in a state where a predetermined cable-end length including the shield line 28, the insulator 26 and the signal line 24 exposed in a stepwise fashion adjacent to the distal end of the coaxial cable 12 extends straight (FIG. 8A). Each of the first and second surfaces 20, 22 of the body 14 is provided with a pair of walls 50 at a location between the region 32*b* of the signal terminal support section 32 and the region 34*b* of the ground terminal support section 34, the walls 50 retaining the signal line 24 exposed in a straight form at the distal end of the coaxial cable 12 to be positioned parallel to the center axis 14*a* (FIGS. 3A and 9B).

The signal terminal 16 is fixed to the signal terminal support section 32 by various means, such as press-fitting. In the illustrated configuration, a projecting edge 52 projecting on a back side opposite to the signal contact face 38*a* is formed at the longitudinal end of the signal contact part 38 of the signal terminal 16 by, e.g., bending the material of the signal terminal 16 (FIGS. 4A and 4B). Corresponding thereto, a slit 54 capable of receiving the projecting edge 52 is formed to be recessed at the longitudinal end of the region 32*a* in the signal terminal support section 32 (FIG. 3A). The projecting edge 52 is press-fitted into the slit 54, so that the signal terminal 16 is fixed to the signal terminal support section 32. Note, in order to fix the signal terminal 16, various other means, such as bonding, welding, etc., may be adopted in addition to or instead of the press-fitting. Alternatively, the signal terminal 16 may be integrally fixed to the body 14 by insert molding.

The ground terminal 18 is fixed to the ground terminal support section 34 by various means, such as press-fitting. In the illustrated configuration, a projecting edge 56 projecting on a back side opposite to the ground contact face 44 is formed at the longitudinal end of the ground contact part 44 of the ground terminal 18 by, e.g., bending the material of the ground terminal 18, and a hook 58 projecting on the same side as the projecting edge 56 is formed at the approximately center of the outer edge of the intermediate part 48 of the ground terminal 18 by, e.g., punching the material of the ground terminal 18 (FIGS. 5A and 5B). Corresponding thereto, in the ground terminal support section 34, a slit 60 capable of receiving the projecting edge 56 is formed to be recessed at the longitudinal end of the region 34*a*, and a slot 62 into which the hook 58 can be fit is formed at the approximately center of the region 34*c* (FIG. 3A). The projecting edge 56 and the hook 58 are press-fitted into the slit 60 and the slot 62, respectively, so that the ground terminal 18 is fixed to the ground terminal support section 34. Note, in order to fix the ground terminal 18, various other means, such as bonding, welding, etc., may be adopted in addition to or instead of the press-fitting. Alternatively, the ground terminal 18 may be integrally fixed to the body 14 by insert molding.

As described above, in the module 10, the first signal terminal 16 and the first ground terminal 18 are provided on the first surface 20 of the body 14 in such a manner that the first signal contact face 38*a* and the first ground contact face 44*a* are arranged, on the first surface 20, in parallel with each other with the predetermined pitch P defined therebetween; and the second signal terminal 16 and the second ground terminal 18 are provided on the second surface 22 of the body 14 in such a manner that the second signal contact face 38*a* and the second ground contact face 44*a* thereof are arranged, on the second surface 22, in parallel with each other with the pitch P defined therebetween in the same way as the first surface 20 (FIGS. 6 and 8A). The relative positional relationship between the signal terminal 16 and the ground terminal 18 on the first surface 20 is the same as the relative positional relationship between the signal terminal 16 and the ground terminal 18 on the second surface 22 (FIGS. 1 and 7). Thus, as depicted in FIG. 9A, the first signal contact face 38*a* (or the signal contact part 38) arranged on the first surface 20 is located opposite to the second ground contact face 44*a* (or the ground contact part 44) arranged on the second surface 22, and the first ground contact face 44*a* (or the ground contact part 44) arranged on the first surface 20 is located opposite to the second signal contact face 38*a* (or the signal contact part 38) arranged on the second surface 22.

The module 10 is attached to the coaxial cable 12 in a manner as described below. First, the distal end length of the single first coaxial cable 12, which has been subjected to the aforementioned terminal treatment, is put in the first surface 20 of the body 14 through the first cable support section 36 and is moved ahead along the center axis 14*a* with the exposed signal line 24 facing forward (FIG. 2). The signal line 24 exposed in the distal end length of the coaxial cable 12 passes through the shield line connection part 46 of the first ground terminal 18, is inserted between the pair of walls 50 provided on the first surface 20, and is placed in contact with the joint face 40*a* of the signal line connection part 40 of the first signal terminal 16. Along with this insertion operation, the shield line 28 exposed in the distal end length of the coaxial cable 12 is inserted into the shield line connection part 46 of the first ground terminal 18, and is placed in contact with the joint face 46*c*. In this state, the signal line 24 is joined to the joint face 40*a* of the signal line connection part 40 and the shield line 28 is joined to the joint face 46*c* of the shield line connection part 46, through, e.g., soldering. Thus, the single first coaxial cable 12 is connected to the first signal terminal 16 and the first ground terminal 18, which are mounted on the first surface 20 of the body 14. In addition, the distal end length of the single second coaxial cable 12, which has been subjected to the aforementioned terminal treatment, is connected, through the same procedure as the above-described procedure, to the second signal terminal 16 and the second ground terminal 18, which are mounted on the second surface 22 of the body 14 (FIG. 7). In this way, the single module 10 is attached to the distal ends of a pair of coaxial cables 12.

The first and second coaxial cables 12, to which the module 10 is attached, are supported at mutually corresponding positions on the first and second surfaces 20, 22 of the body 14 (or positions on the mutually opposite sides of the body 14), with the distal end lengths of the respective coaxial cables extending straight (FIGS. 8A and 8B). In this state, the signal line 24 of each of the first and second coaxial cables 12 is held between the pair of walls 50 formed on each surface 20, 22, so as to be positioned along the center axis 14*a* of the body 14 (FIG. 9B), and is placed in contact with the joint face 40*a* of the signal line connection part 40 of each of the first and second signal terminals 16 (FIG. 9A). Further, the shield line 28 of each of the first and second coaxial cables 12 is located along the center axis 14*a* of the body 14, and is placed in contact with the joint face 46*c* of the shield line connection part 46 of each of the first and second ground terminals 18 (FIG. 9C).

In the module 10 having the aforementioned configuration, it is possible to collectively connect a pair of coaxial cables 12 arranged on the first and second surfaces 20, 22 of the body 14 to a connection counterpart (not depicted) by using the single module 10, so that, when the module 10 is applied to a multipole configuration as explained later, it is possible to prevent the dimensions of a multipole connector from increasing, and to increase the number of cables capable of being connected through the multipole connector. Further in the module 10, the second ground contact face 44*a* is located opposite to the first signal contact face 38*a* and the second signal contact face 38*a* is located opposite to the first ground contact face 44*a*, so that it is possible to easily establish a transmission line configuration wherein a plurality of ground contact parts 44 each having the ground contact face 44*a* surround the single signal contact part 38 having the signal contact face 38*a*, by, e.g., arranging a plurality of modules 10 in parallel with each other in a matrix form. Thus, according to the module 10, when applied to a multipole configuration as explained later, it is possible to prevent the high-frequency transmission characteristics of each coaxial cable 12 from degrading.

Further, in the module 10 having the aforementioned configuration, the first and second surfaces 20, 22 of the body 14 have mutually identical configurations and are formed at locations rotationally symmetrical through 180 degrees with respect to each other about the center axis 14*a* of the body 14. Therefore, the arrangement of the first signal contact face 38*a* and the first ground contact face 44*a* on the first surface 20 has a rotationally symmetrical relationship, through 180 degrees about the center axis 14*a*, to the arrangement of the second signal contact face 38*a* and the second ground contact face 44*a* on the second surface 22. According to this configuration, it is possible to connect the module 10 to the connection counterpart regardless of the directionality of the first and second surfaces 20, 22 of the body 14.

Further, in the module 10 having the aforementioned configuration, the single first signal terminal 16 and the single first ground terminal 16 having the first ground contact face 44*a* arranged in parallel with and at one side of the first signal contact face 38*a* of the first signal terminal 16 are attached to the first surface 20 of the body 12, and the single second signal terminal 16 and the single second ground terminal 18 having the second ground contact face 44*a* arranged in parallel with and at one side of the second signal contact face 38*a* of the second signal terminal 16 are attached to the second surface 22 of the body 12. In other words, the single first signal contact face 38*a* and the single first ground contact face 44*a* are arranged on the first surface 20, and the single second signal contact face 38*a* and the single second ground contact face 44*a* are arranged on the second surface 22. According to this configuration, it is possible to simplify the structure of the module 10.

Further, in the module 10 having the aforementioned configuration, the shape of the first signal terminal 16 is identical to the shape of the second signal terminal 16, and the shape of the first ground terminal 18 is identical to the shape of the second ground terminal 18. According to this configuration, it is possible to reduce the components of different types in the module 10.

Further, in the module 10 having the aforementioned configuration, the body 14 is provided, on the first surface 20, with the first cable support section 36 for supporting the first coaxial cable 12 (or the sheathed portion thereof) and, on the second surface 22, with the second cable support section 36 for supporting the second coaxial cable 12 (or the sheathed portion thereof). According to this configuration, it is possible to stably hold the distal end length of each coaxial cable 12 on the body 14.

Further, in the module 10 having the aforementioned configuration, the first signal terminal 16 includes the signal line connection part 40 adapted to be connected to the signal line 24 of the first coaxial cable 12, the first ground terminal 18 includes the shield line connection part 46 adapted to be connected to the shield line 28 of the first coaxial cable 12, and, on the first surface 20 of the body 14, the signal line connection part 40, the shield line connection part 46 and the first cable support section 36 are aligned with each other along the longitudinal direction of the first signal terminal 16 and the first ground terminal 18. Also, the second signal terminal 16 includes the signal line connection part 40 adapted to be connected to the signal line 24 of the second coaxial cable 12, the second ground terminal 18 includes the shield line connection part 46 adapted to be connected to the shield line 28 of the second coaxial cable 12, and, on the second surface 22 of the body 14, the signal line connection part 40, the shield line connection part 46 and the second cable support section 36 are aligned with each other along the longitudinal direction of the second signal terminal 16 and the second ground terminal 18. According to this configuration, it is possible to attach the module 10 to the first and second coaxial cables 12 in a state where the distal end length of each coaxial cable 12 extends straight, and thus possible to reduce the dimensions of the body 14, in particular the transverse dimension, to a level nearly equal to the outer diameter of the sheathed portion of the coaxial cable 12.

As will be understood from the above description, the module 10 can be fabricated from the minimum number of simple components (i.e., the body 14, the signal terminals 16 and the ground terminals 18), the signal terminal 16 and the ground terminal 18 can be stably connected to the signal line 24 and the shield line 28 of the coaxial cable 12 by a simple work, and the module 10 can be applied not only to a multipole configuration but also a high-density configuration, due to the reduction in the dimensions of the body 14, in particular the transverse dimension.

The module 10 may constitute a coaxial cable connector adapted to mate with a counterpart connector, by fitting a single module 10 to a housing. Alternatively, the module 10 may constitute a multipole connector for a coaxial cable, by assembling a plurality of modules 10 in a single housing. Referring now to FIGS. 10 to 13, the configuration of a multipole connector 70 for a coaxial cable, according to one embodiment, will be explained below.

Figure 10:
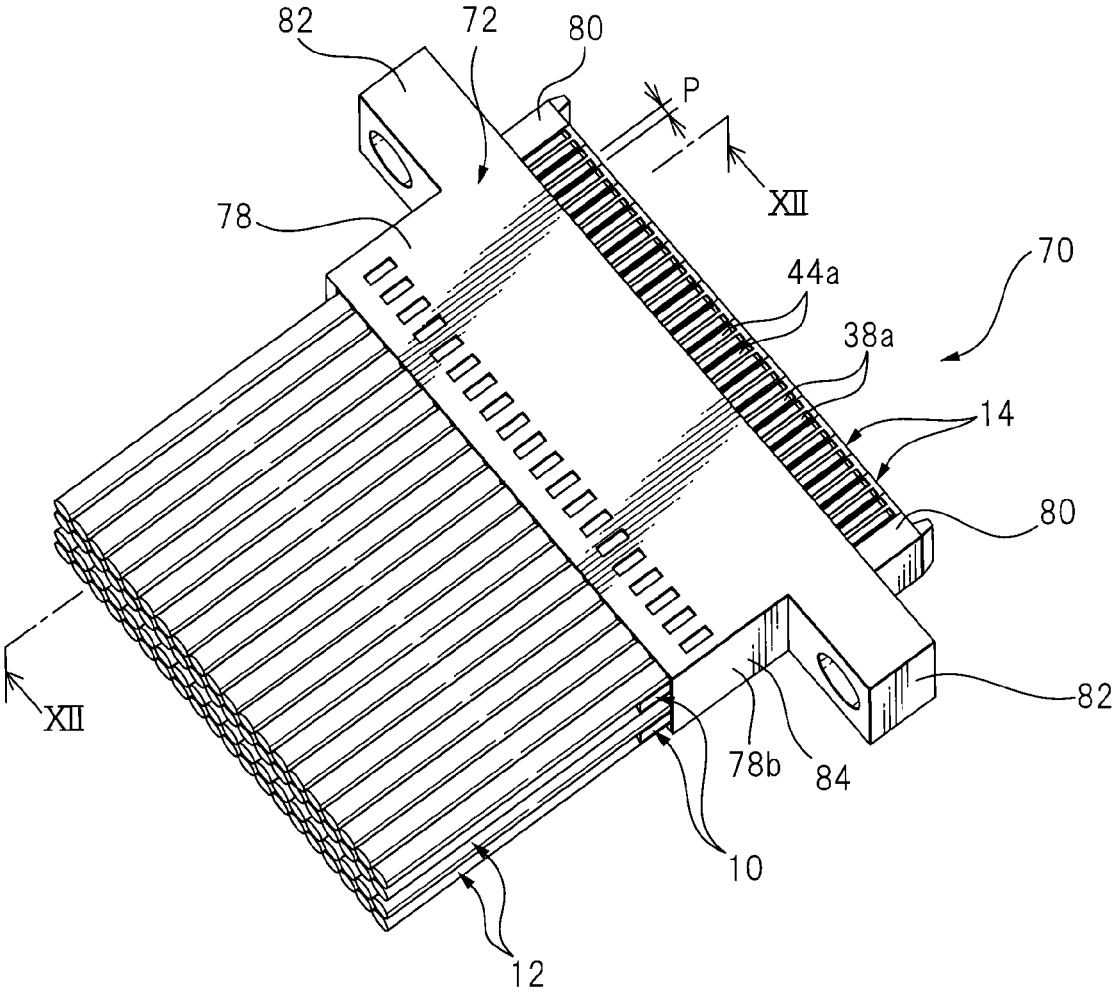
FIG. 10 is a perspective view depicting a multipole connector for a coaxial cable, according to one embodiment of the present invention, with a plurality of coaxial cables connected thereto.

As depicted in FIG. 10, the multipole connector 70 for a coaxial cable (hereinafter referred simply to as "multipole connector 70") include a plurality of modules 10 and a housing 72 receiving and supporting the modules 10 in a parallel arrangement. The housing 72 is a box-like member having a substantially rectangular parallelepiped shape and molded into a unitary piece from an electrical insulating resinous material through, e.g., an injection molding process. The housing 72 includes a hollow body part 78 provided with openings 74, 76 (FIG. 12) at the transversely opposite ends thereof. The housing 72 is further provided, at the longitudinally opposite ends of the body part 78, with a pair of fit parts 80 projecting upright from one end face 78*a* (FIG. 12) of the body part 78, which extends around the opening 74, and a pair of mounting flanges 82 extending upright from the opposite side faces 78*b* of the body part 78 (FIG. 10).

Figure 11:
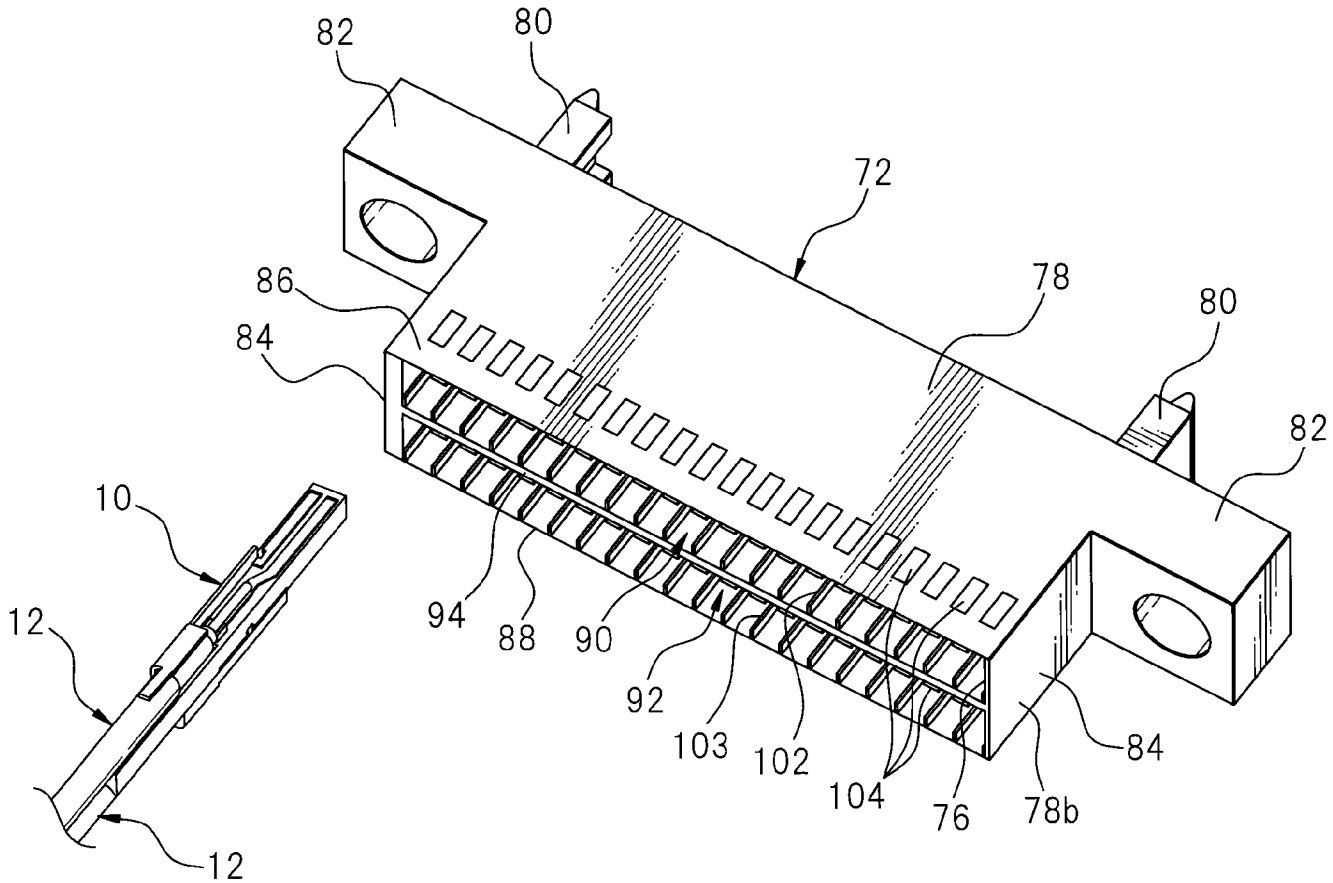
FIG. 11 is a perspective view depicting a housing of the multipole connector of FIG. 10, with a coaxial cable connection module detached.

The body part 78 includes a pair of side walls 84, on which the mounting flanges 82 are respectively formed, and a top wall 86 and a bottom wall 88, each extending perpendicular to the side walls 84. A space for accommodating a plurality of modules 10, i.e., a module support section, is defined inside the side walls 84, the top wall 86 and the bottom wall 88 (FIG. 11). In the illustrated configuration, the housing 72 is provided with a first (upper in FIG. 11) module support section 90 receiving and supporting a set of the plurality of modules 10 in a parallel arrangement and a second (lower in FIG. 11) module support section 92 provided parallel to the first module support section 90 in a tiered manner and receiving and supporting another set of the plurality of modules 10 in a parallel arrangement. The first and second module support sections 90, 92 are defined by a partition wall 94 extending parallel to the top and bottom walls 86, 88 between the opposite side walls 84 of the body part 78, and each of the first and second module support sections 90, 92 is provided with the openings 74, 76 (FIG. 12).

Each of the module support sections 90, 92 includes a front cavity 96 receiving the front half of the module 10 (more specifically, a portion corresponding to the signal contact part 38 side of the signal line connection part 40 of the signal terminal 16 (a right side in FIG. 12)), and a back cavity 98 communicating with the front cavity 96 and receiving the back half of the module 10 (more specifically, a portion corresponding to the cable support section 36 side of the signal line connection part 40 of the signal terminal 16 (a left side in FIG. 12)). The front cavity 96 is smaller in a vertical dimension than the back cavity 98, and thereby a shoulder face 100 adjoining the front cavity 96 is formed at the front end of the back cavity 98. The vertical dimension of the front cavity 96 is substantially equal to the distance between the surfaces of the signal terminals 16 (the signal contact faces 38*a*, etc.), which are exposed on the opposite surfaces 20, 22 of the module 10, and the vertical dimension of the back cavity 98 is substantially equal to the distance between the outermost surfaces of the shield line connection parts 46 of the ground terminals 18, which project from the opposite surfaces 20, 22 of the module 10.

In the back cavity 98 of the first module support section 90, a plurality of ribs 102 extending straight between the opening 76 and the shoulder face 100 are formed in a parallel and equally-spaced arrangement on each of the lower face of the top wall 86 and the upper face of the partition wall 94 of the body part 78, at positions where the ribs 102 on the top wall 86 are opposed to the ribs 102 on the partition wall 94 (the ribs 102 on the upper face of the partition wall 94 are depicted in FIG. 11). Also, in the back cavity 98 of the second module support section 92, a plurality of ribs 103 extending straight between the opening 76 and the shoulder face 100 are formed in a parallel and equally-spaced arrangement on each of the upper face of the bottom wall 88 and the lower face of the partition wall 94 of the body part 78, at positions where the ribs 103 on the bottom wall 88 are opposed to the ribs 102 on the partition wall 94 (the ribs 103 on the upper face of the bottom wall 88 are depicted in FIG. 11). The interval between the ribs 102 or 103, arranged side-by-side in each array, is slightly smaller than the transverse dimension of the body 14 of the single module 10. The distance between the mutually opposing ribs 102 on the top and partition walls 86, 94 and the distance between the mutually opposing ribs 103 on the bottom and partition walls 88, 94 are substantially equal to the distance between the opposite surfaces 20, 22 of the body 14.

Figure 12:
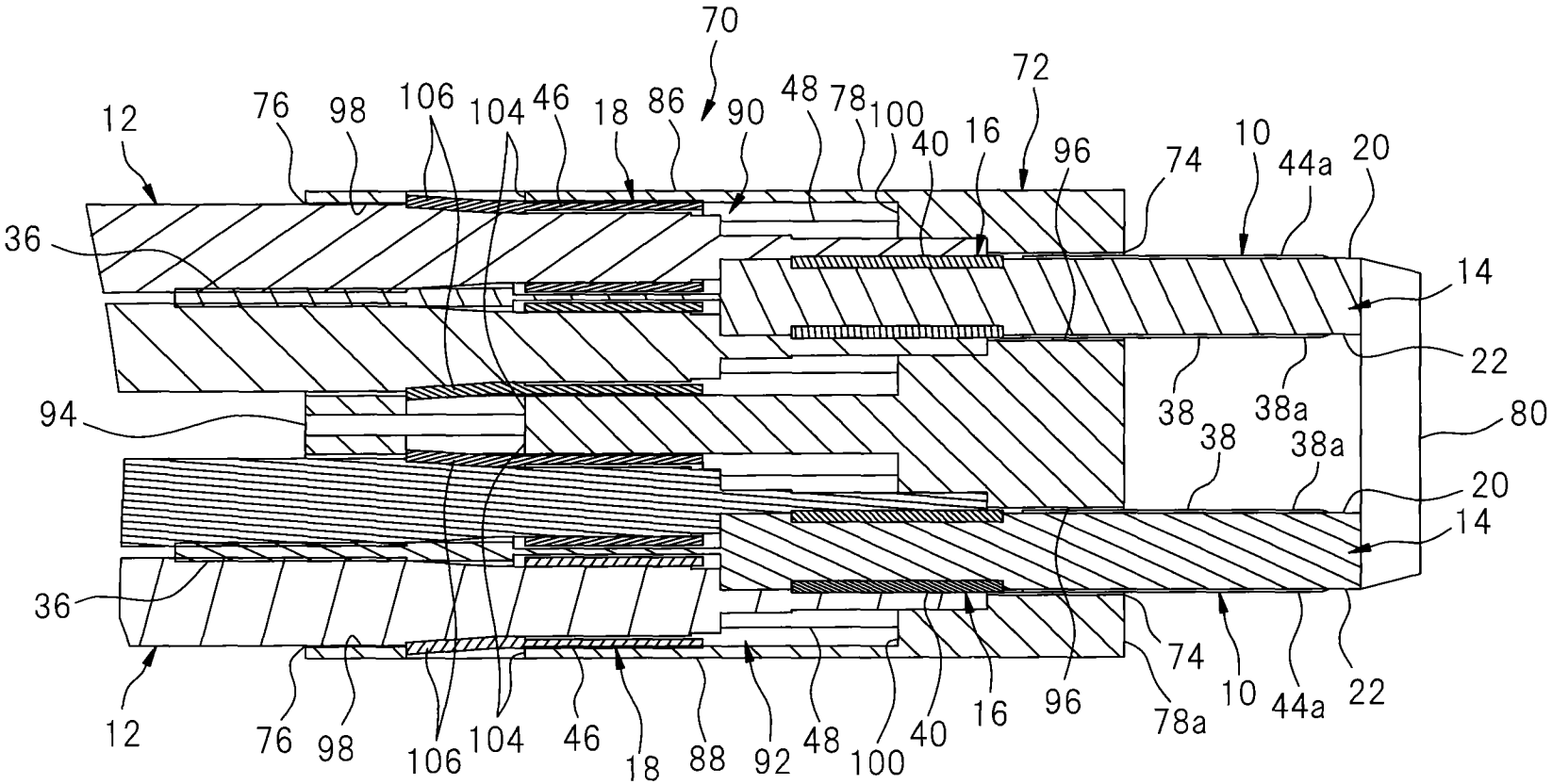
FIG. 12 is a sectional view taken along a line XII-XII of FIG. 10.

In the back cavity of each of the module support sections 90, 92, a set of retainer holes 104 are formed in each of the top wall 86, the bottom wall 88 and the partition wall 94 of the body part 78, at positions between respective pairs of ribs 102 or 103 arranged side-by-side in each array (FIGS. 11 and 12). Each retainer hole 104 is capable of individually receiving an anchor piece 106 (FIGS. 1 and 7) extending backward and obliquely upward from the shield line connection part 46 of the ground terminal 18 attached to each surface 20, 22 of the module 10.

The first and second module support sections 90, 92 have the configurations identical to each other, and are capable of supporting the same number of modules 10. Each of the modules 10 with two coaxial cables 12 connected thereto in the aforementioned way is supported in each of the module support sections 90, 92, in such a manner that the front half of the module 10 is received in the front cavity 96 and the back half of the module 10 is received between the upper and lower pairs of ribs 102, 103 arranged side-by-side in respective arrays in the back cavity 98. In this configuration, the longitudinal front ends of the intermediate parts 48 of the ground terminals 18 on the opposite surfaces 20, 22 are abutted on the shoulder face 100, and the longitudinal back ends of the anchor pieces 106 of the ground terminals 18 are abutted on the back end edges of the retainer holes 104 through the spring-like snap motion of the anchor pieces 106 (FIG. 12), and thereby each module 10 is supported and fixed in each module support section 90, 92 in the longitudinal direction of the body 14. Further, in a state where the predetermined number of modules 10 are accommodated in each module support section 90, 92, the bodies 14 of the adjoining modules 10 are abutted on each other, and thereby each module 10 is supported and fixed in each module support section 90, 92 in the transverse direction of the body 14. Furthermore, due to the aforementioned dimensional relationship between each module support section 90, 92 and the module 10, each module 10 is supported and fixed in each module support section 90, 92 in the vertical direction. According to the above configuration, the modules 10 are individually supported snugly in the module support sections 90, 92 in a fixed and stable manner.

In a state where the predetermined number of modules 10 are supported in each module support section 90, 92 in a fixed manner as explained above, the predetermined lengths of the front halves of the modules 10 project outward from the end face 78*a* of the body part 78 of the housing 72 (FIG. 12), and the projecting lengths are flatly arranged side-by-side between the pair of fit parts 80 with no gap defined therebetween (FIG. 10). In this state, the front halves of the plurality of modules 10 cooperate with the pair of fit parts 80 to form a mating structure capable of mating with a counterpart connector. Further in this state, the plurality of modules 10 supported in each module support sections 90, 92 are configured so that the first signal contact faces 38*a* and the first ground contact faces 44*a*, each of which is arranged on the first surface 20 of the body 14, are alternately arranged in parallel with each other with the predetermined pitch P (FIG. 10) maintained uniformly throughout, and that the second signal contact faces 38*a* and the second ground contact faces 44*a*, each of which is arranged on the second surface 22 of the body 14, are alternately arranged in parallel with each other with the predetermined pitch P maintained uniformly throughout.

Figure 13:
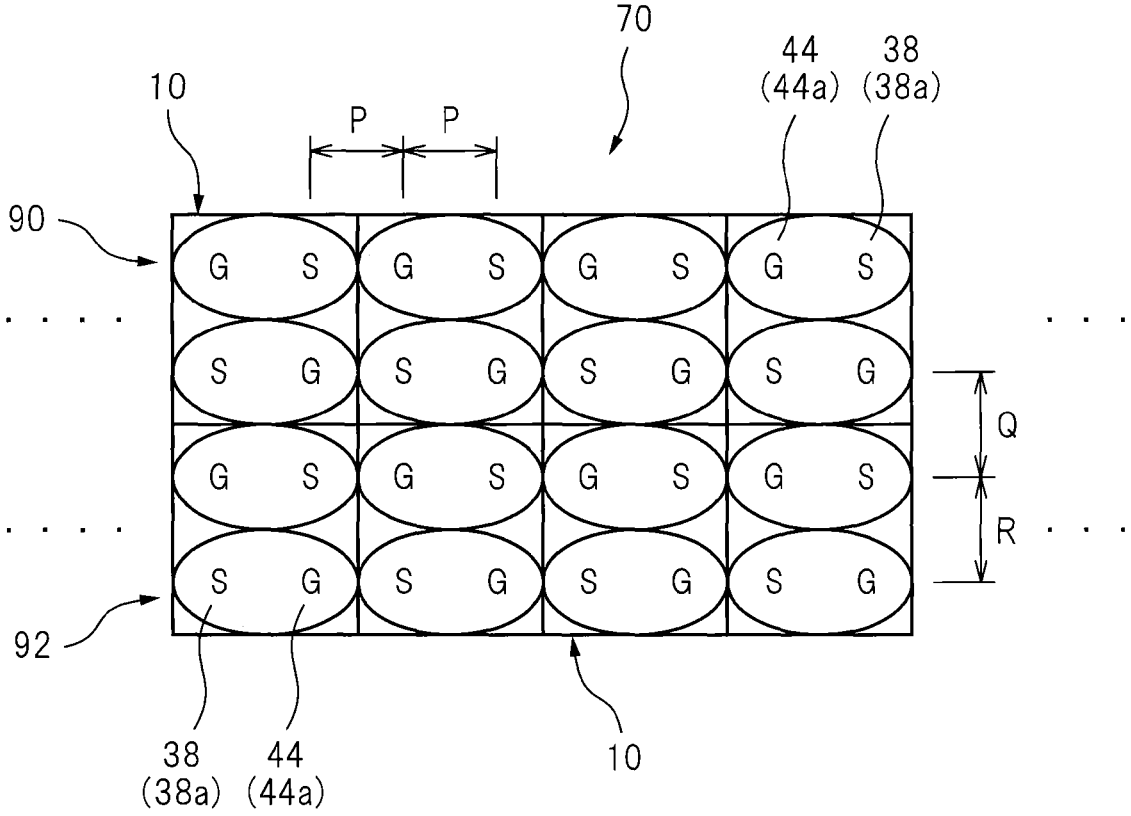
FIG. 13 is an illustration diagrammatically depicting a transmission line configured in the multipole connector of FIG. 10.

FIG. 13 diagrammatically depicts a transmission line configured by the signal contact faces 38*a* (or the signal contact parts 38) and the ground contact faces 44*a* (or the ground contact parts 44) of the plurality of modules 10 provided in the multipole connector 70. As illustrated, the plurality of modules 10 are supported in the respective module support sections 90, 92 and thus are arranged in parallel with each other in a matrix form in the housing 72, so that it is possible to establish a transmission line configuration wherein the plurality of ground contact parts 44 each having the ground contact face 44*a* surround the single signal contact part 38 having the signal contact face 38*a*. The illustrated transmission line configuration is capable of reducing a crosstalk between signal lines, and also effectively reducing transmission loss, such as attenuation or reflection of signals. Note, in the illustrated configuration, the pitch P determined for the signal contact faces 38*a* and the ground contact faces 44*a* in the longitudinal direction of the housing body part of the multipole connector 70 is different from pitches Q, R determined for the signal contact faces 38*a* and the ground contact faces 44*a* in the vertical direction of the housing body part of the multipole connector 70. The pitches Q, R are respectively determined by the vertical dimension (or thickness) of the partition wall 94 of the housing 72 and the vertical dimension (or thickness) of the body 14 of each module 10. Therefore, also in the vertical direction of the multipole connector 70, it is possible to arrange the signal contact faces 38*a* and the ground contact faces 44*a* with the pitch P defined therebetween, by suitably adjusting the thicknesses of the partition wall 94 and the body 14.

In the multipole connector 70 having the aforementioned configuration, a plurality of modules 10 are received in the housing 72 in a parallel arrangement, so that it is possible to prevent the dimensions of the multipole connector 70 from increasing, to prevent the high-frequency transmission characteristics of each coaxial cable 12 from degrading, and to increase the number of cables capable of being connected through the multipole connector 70. In particular, in the multipole connector 70, it is possible to establish a multipole connector configuration fixedly attached to the distal ends of the coaxial cables 12, through an extremely simple work such that a predetermined number of modules 10, each of which is connected to a pair of coaxial cables 12, are inserted into the module support sections 90, 92 of the housing 72.

Further, the plurality of modules 10 supported in the housing 72 are configured so that the signal contact faces 38*a* and the ground contact faces 44*a*, each of which is arranged on each of the first and second surfaces 20, 22 of the body 14, are alternately arranged in parallel with each other with the predetermined pitch P maintained uniformly throughout, and therefore, in the transmission line configuration wherein the plurality of ground contact parts 44 surround the single signal contact part 38, it is possible to uniformize the distances between the signal lines and the ground lines and thereby to ensure impedance matching. In the configuration that the housing 72 includes the two-tiered module support sections 90, 92, it is also possible to surround the single signal contact part 38 (or the signal contact face 38*a*) by the plurality of ground contact parts 44 (or the ground contact faces 44*a*) in the vertical direction. Note, the number of the modules 10 supported in each module support section 90, 92 is not particularly limited. Also, the number of tiers of the module support sections is not limited to two, but may be one or at least three. The number of the modules 10 provided in the multipole connector 70 may be suitably set in accordance with application requirement.

Figure 14:
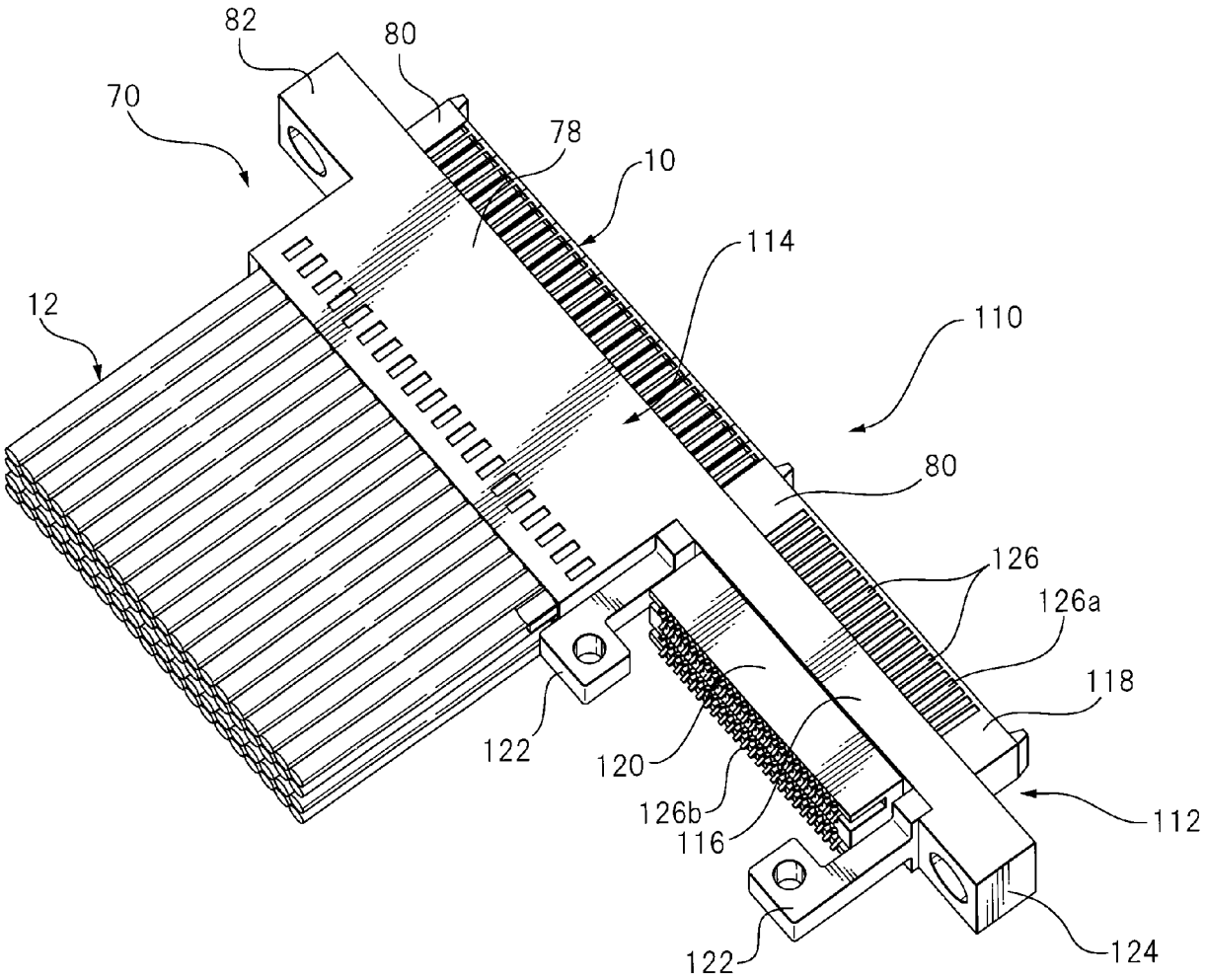
FIG. 14 is a perspective view depicting a multipole composite connector, according to one embodiment of the present invention, with a plurality of coaxial cables connected thereto.
Figure 15:
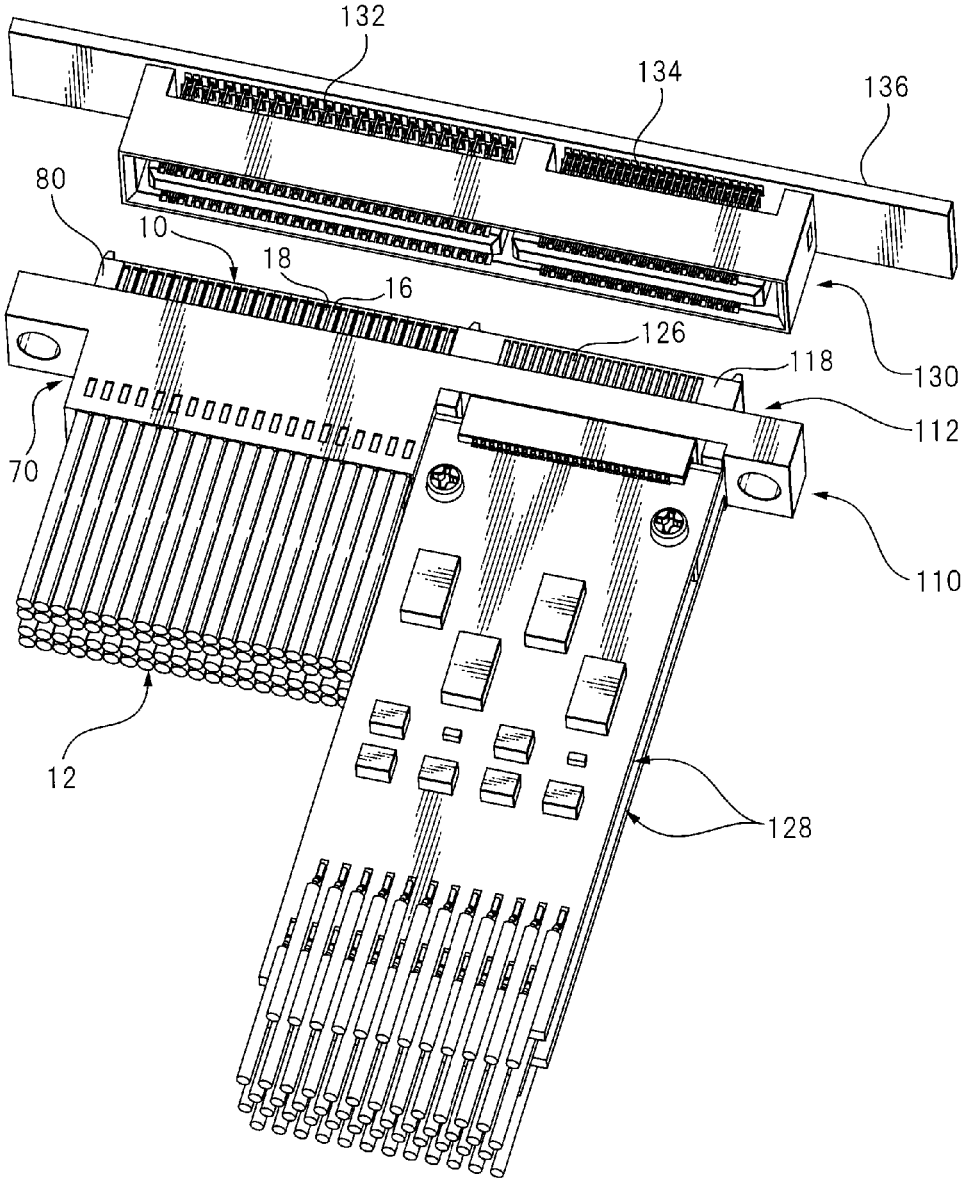
FIG. 15 is a perspective view depicting the multipole composite connector of FIG. 14, together with a counterpart connector.

The multipole connector 70 may be structurally integrated with a connector for detachably connecting a non-coaxial cable (e.g., a conventional cable for transmitting a low frequency signal) to a counterpart. Referring now to FIGS. 14 and 15, the configuration of a multipole composite connector 110 according to one embodiment, in which the multipole connector 70 is combined with a connector for a non-coaxial cable in a unitary manner, will be explained below.

As depicted in FIG. 14, the multipole composite connector 110 includes a connector 112 for a non-coaxial cable (hereinafter referred simply to as "low speed connector 112"), which shares a housing with the multipole connector 70. A composite housing 114 of the multipole composite connector 110 is configured such that a housing body 116 for the low speed connector 112 is formed integrally with the housing 72 of the multipole connector 70 instead of one of the mounting flanges 82 (the right one in FIG. 10) thereof. More specifically, the composite housing 114 includes, in an integral or unitary manner, the body part 78 of the housing 72 of the multipole connector 70, the pair of fit parts 80 projecting frontward from the body part 78, the single mounting flange 82 extending laterally from one side face of the body part 78, the housing body 116 extending from the other side face of the body part 78, a second fit part 118 projecting frontward from the housing body 116 and connected integrally to one fit part 80, a third fit part 120 projecting backward from the housing body 116, a pair of mounting parts 122 projecting backward from the housing body 116 at locations near the longitudinally opposite ends of the third fit part 120, and a mounting flange 124 extending from the one side face of the housing body 116.

The low speed connector 112 includes a plurality of terminals 126 attached to the housing body 116 in a two-tiered parallel arrangement (FIG. 14). Each terminal 126 includes a contact part 126*a* supported on the second fit part 118 and a lead part 126*b* supported on the third fit part 120. The plurality of terminals 126 may be configured so that all terminals 126 are used as signal lines or one or more terminals 126 are used as a ground line(s), depending on application requirement. The low speed connector 112 has a conventional configuration and thus is not explained in further detail.

In the illustrated configuration, the low speed connector 112 is configured as a board mount connector capable of being mounted on two circuit boards 128 (FIG. 15). Also in the illustrated configuration, the multipole composite connector 110 formed by combining the multipole connector 70 with the low speed connector 112 in a unitary manner is configured to be able to mate with a composite board mount connector 130 (FIG. 15). The composite board mount connector 130 includes a plurality of terminals 132 for high speed transmission, capable of conductively contacting respectively the plurality of signal and ground terminals 16, 18 of the multipole connector 70, and a plurality of terminals 134 for low speed transmission, capable of conductively contacting respectively the plurality of terminals 126 of the low speed connector 112, and is mounted on a board 136.

In the multipole composite connector 110 having the aforementioned configuration, the multipole connector 70 is combined with the low speed connector 112 in an unitary manner, so that it is possible to simplify a mounting work or a mating work, in comparison with a configuration using a multipole connector for a coaxial cable and another connector for a non-coaxial cable separated from the multipole connector. Further, the multipole composite connector 110 includes the multipole connector 70, and thus can exhibit various effects relating to high frequency transmission, which are also exhibited by the multipole connector 70. Note, the configuration of the low speed connector 112 of the multipole composite connector 110 or the configuration of the counterpart connector is not limited to the illustrated configuration.

FIGS. 16 to 19 depict a coaxial cable connection module 140 according to a second embodiment (hereinafter referred simply to as "module 140"). The module 140 has a configuration substantially corresponding to that of the module 10 of the first embodiment except for the configuration of a ground line. The components of the module 140, corresponding to those of the module 10, are denoted by common reference numerals and detailed explanations thereof are not repeated.

Figure 16:
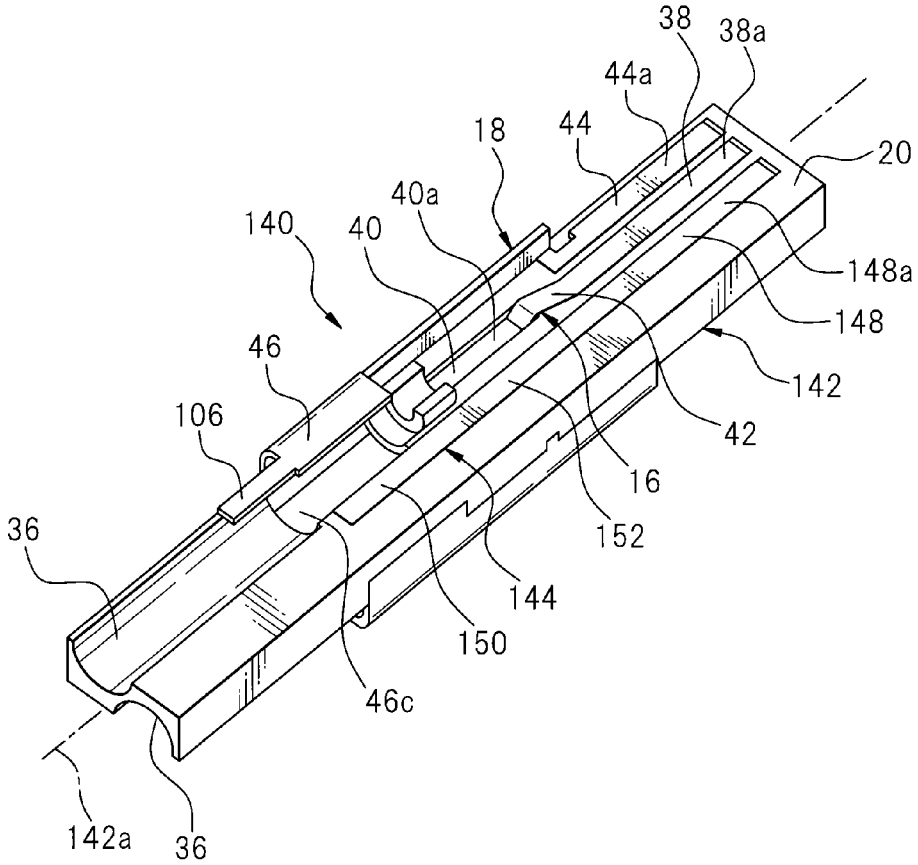
FIG. 16 is a perspective view depicting a coaxial cable connection module according to another embodiment of the present invention.

As depicted in FIG. 16, the module 140 includes a body 142 having electrical insulating properties, a signal terminal 16 attached to the body 142 and capable of being connected to a signal line of a coaxial cable 12, a ground terminal 18 attached to the body 142 and capable of being connected to a shield line of the coaxial cable 12, and another ground terminal 144 (separate from the ground terminal 18) attached to the body 142 and capable of being connected to the shield line of the coaxial cable 12. The body 142 includes a first surface 20 and a second surface 22 opposite to the first surface 20. The module 140 is provided, on each of the first and second surfaces 20, 22 of the body 142, with a terminal set including a single signal terminal 16 and a pair of ground terminals 18, 144. The module 10 is configured so as to enable first and second coaxial cables 12 having mutually identical structures and arranged on the first and second surfaces 20, 22 to be collectively connected to a connection counterpart (not depicted).

The body 142 is a bar member having a substantially rectangular parallelepiped shape and molded into a unitary piece from an electrical insulating resinous material through, e.g., an injection molding process. The first surface 20 and the second surface 22 are formed at locations rotationally symmetric through 180 degrees with respect to each other about a center axis 142*a* (FIG. 16) extending in the longitudinal direction of the body 142.

Figure 18:
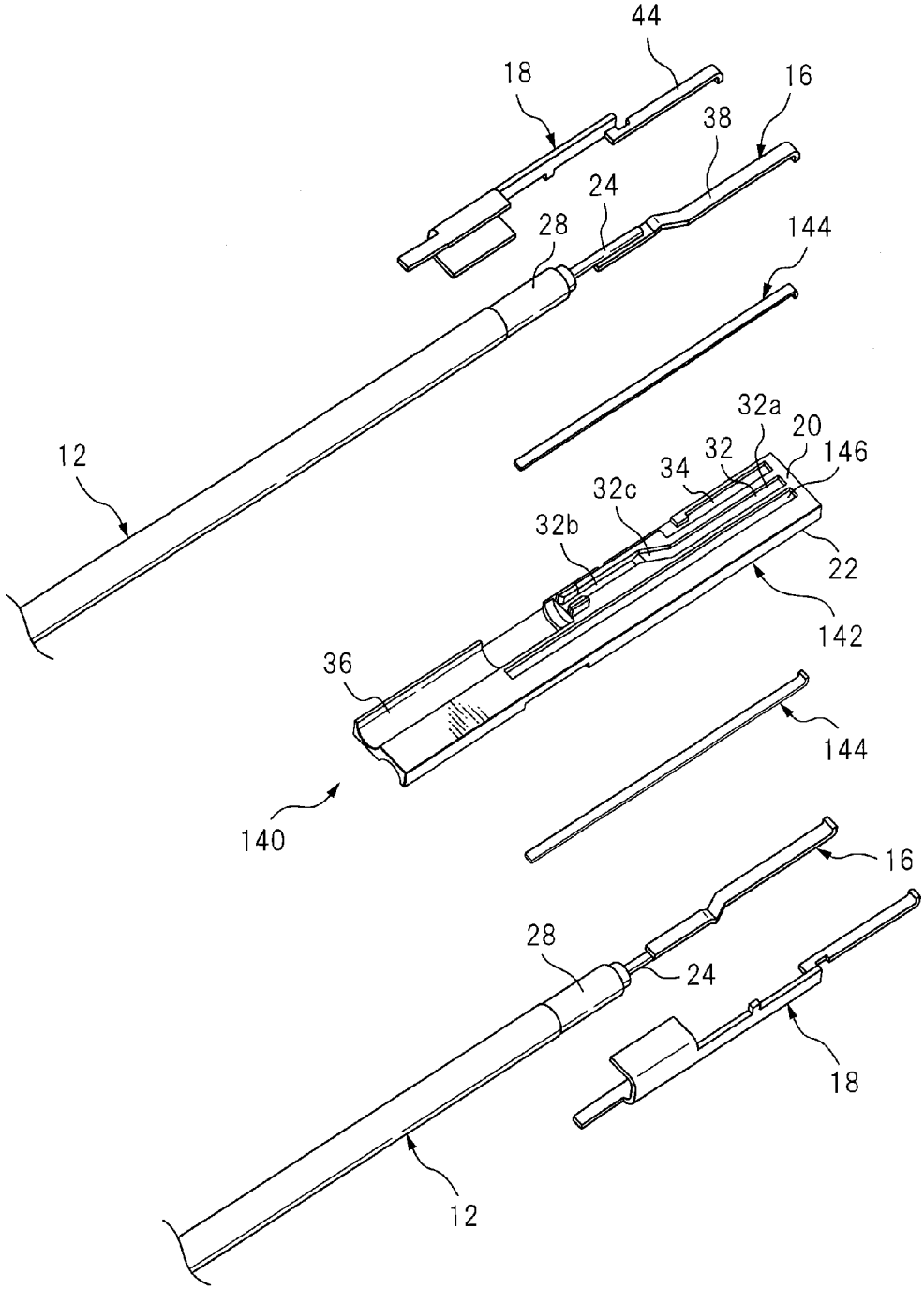
FIG. 18 is an exploded perspective view depicting the coaxial cable connection module of FIG. 16, together with a coaxial cable.

As depicted in FIG. 18, on the first surface 20, a first signal terminal support section 32 for supporting a single first signal terminal 16, a first ground terminal support section 146 for supporting a single first ground terminal 144, a third ground terminal support section 34 for supporting a single third ground terminal 18, and a first cable support section 36 for supporting a portion of a single first coaxial cable 12 having the insulating sheath 30 (i.e., a sheathed portion), are provided. Similarly, on the second surface 22, a second signal terminal support section 32 for supporting a single second signal terminal 16, a second ground terminal support section 146 for supporting a single second ground terminal 144, a fourth ground terminal support section 34 for supporting a single fourth ground terminal 18, and a second cable support section 36 for supporting a portion of a single second coaxial cable 12 having the insulating sheath 30 (i.e., a sheathed portion), are provided.

Figure 19:
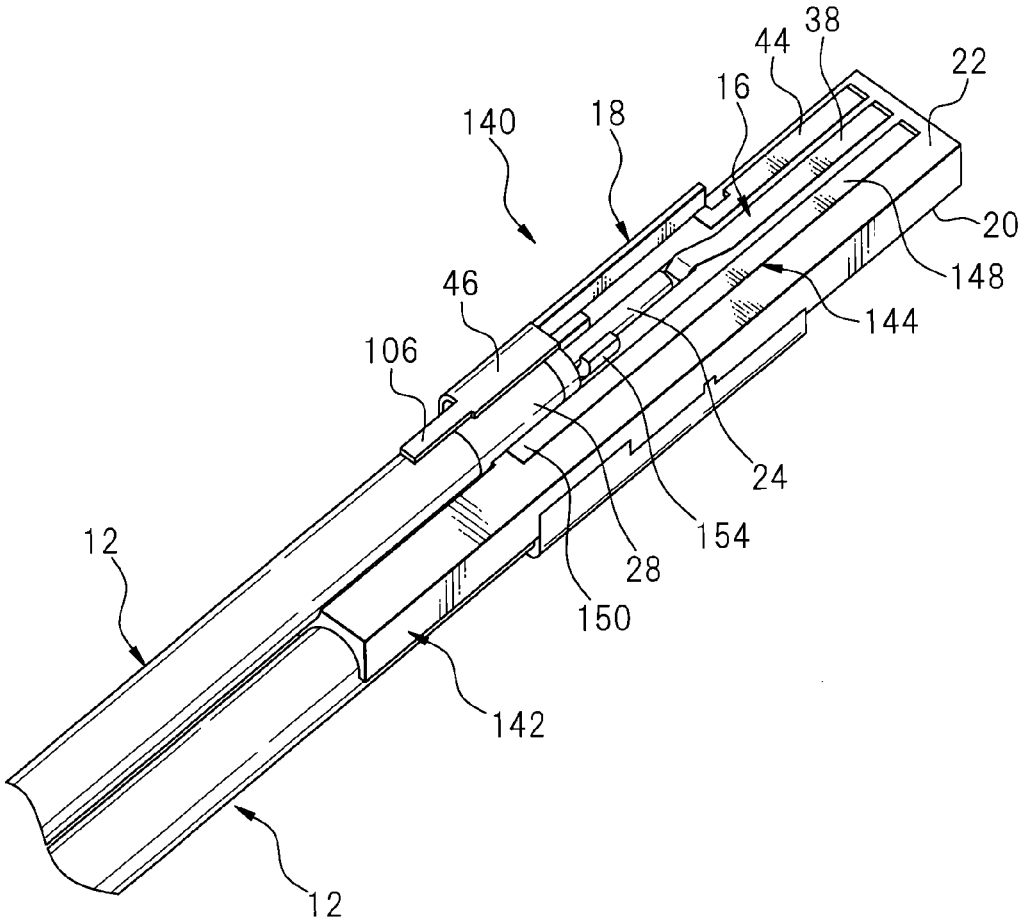
FIG. 19 is a perspective view depicting the configuration of a second surface side of a body of the coaxial cable connection module of FIG. 16, with a coaxial cable connected to the second surface side.

In the illustrated embodiment, the first and second surfaces 20, 22 of the body 142 have mutually identical configurations (FIGS. 16 and 19). Therefore, it should be considered that features depicted in the drawings in connection with the first surface 20 are the same as features in the second surface 22, unless otherwise particularly indicated.

The configuration relating to the first and second signal terminals 16 and the third and fourth ground terminals 18 of the module 140 is substantially the same as the configuration relating to the first and second signal terminals 16 and the first and second ground terminals 18 of the module 10, except for the followings. In the module 140, the signal terminal 16 is formed so that the signal line connection part 40 has a difference in level in a material thickness direction with respect to the intermediate part 42, and thereby the signal contact face 38*a* and the joint face 40*a* are arranged in different virtual planes parallel to each other. Correspondingly, the signal terminal support section 32 of the body 142 has a shape in which the region 32*b* receiving the signal line connection part 40 is recessed to a depth further than the regions 32*a* and 32*c* respectively receiving the signal contact part 38 and the intermediate part 42 (FIG. 18). On each surface 20, 22 of the body 142, the signal terminal support section 32, the ground terminal support section 34 and the cable support section 36 are provided at locations deviated to one side from the center axis 142*a*.

As depicted in FIG. 16, each of the first and second ground terminals 144 is a pin-shaped element formed from a good electro-conductive sheet metal material through, e.g., a press forming process. Each ground terminal 144 includes, in an integral or unitary manner, a ground contact part 148 formed adjacent to one longitudinal end (a right end in FIG. 16) and capable of contacting a ground conductor of a connection counterpart (not depicted), a shield line connection part 150 formed adjacent to the other longitudinal end (a left end in FIG. 16) and capable of being connected to a shield line 28 of a coaxial cable 12, and an intermediate part 152 extending between the ground contact part 148 and the shield line connection part 150. The ground contact part 148, the shield line connection part 150 and the intermediate part 152 entirely extend straight in shape. A flat ground contact face 148*a* capable of contacting the ground conductor of the connection counterpart (not depicted) is formed on the ground contact part 148. The ground contact face 148*a* has a substantially rectangular strip-like profile, as seen in a plan view, substantially identical to the profiles of the signal contact face 38*a* and the ground contact face 44*a*.

Each of the first and second ground terminal support sections 146 of the body 142 is formed as a groove recessed from each surface 20, 22 to a uniform depth nearly equal to the material thickness of the ground terminal 144, and has a shape and a dimension enabling the entirety of the ground terminal 144 to be snugly received therein. The ground terminal support section 146 is provided on each surface 20, 22 at a location deviated from the center axis 142*a* to a side opposite to the signal terminal support section 32, the ground terminal support section 34 and the cable support section 36. In a state where the ground terminal 144 is attached to the ground terminal support section 146, the ground contact face 148*a* of the ground terminal 144 is located to be exposed at a position slightly projecting from each surface 20, 22 of the body 142. The ground terminal 144 can be fixed to the ground terminal support section 146 by various means, such as press-fitting, in the same way as the signal terminal 16 and the ground terminal 18.

Figure 17:
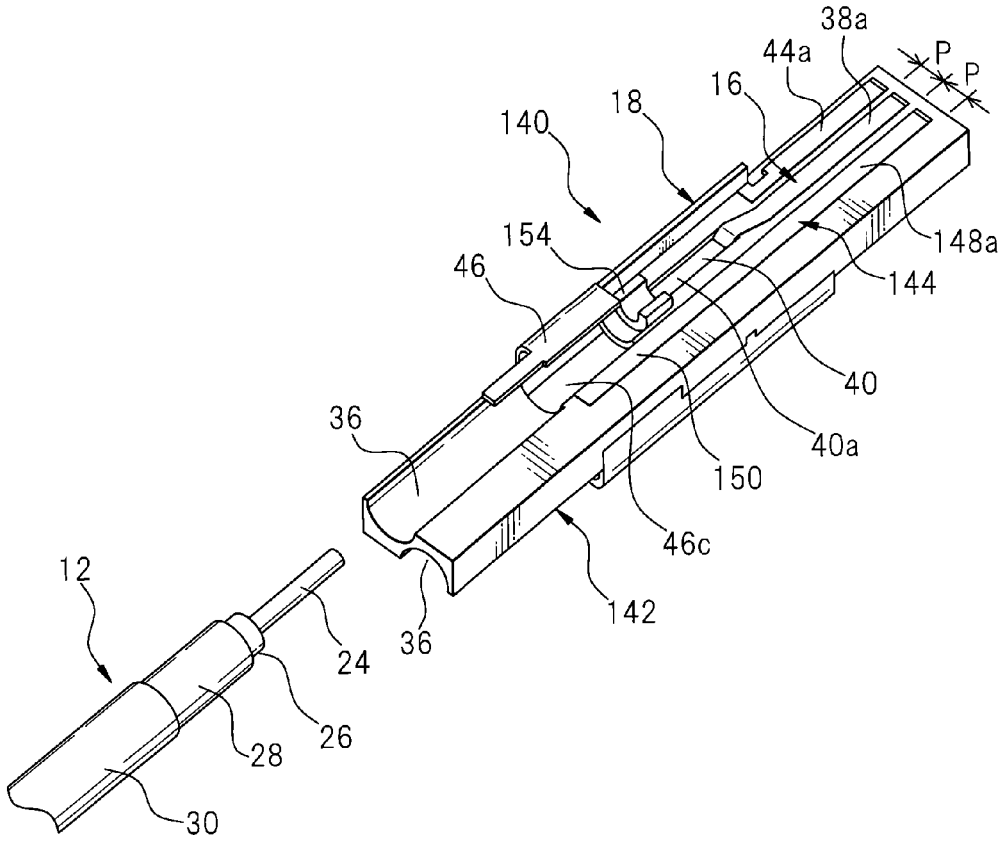
FIG. 17 is a perspective view depicting the coaxial cable connection module of FIG. 16, together with a coaxial cable.

In a state where the signal terminal 16, the ground terminal 18 and the ground terminal 144 are attached to each of the first and second surfaces 20, 22 of the body 142, the signal contact part 38 of the signal terminal 16, the ground contact part 44 of the ground terminal 18 and the ground contact part 148 of the ground terminal 144 are arranged alongside and parallel to each other, and the signal contact face 38*a*, the ground contact face 44*a* and the ground contact face 148*a* are arranged, in a common virtual plane parallel to each surface 20, 22, in parallel with each other with equal spaces or a predetermined pitch P defined therebetween (FIG. 17). Further, on each of the first and second surfaces 20, 22 of the body 142, the signal line connection part 40 of the signal terminal 16 and the shield line connection part 46 of the ground terminal 18 are substantially aligned with each other along the longitudinal direction of the signal terminal 16 and the ground terminal 18, and the shield line connection part 46 of the ground terminal 18 and the shield line connection part 150 of the ground terminal 144 are arranged adjacent to each other in the transverse direction of the ground terminals 18, 144 (FIG. 16). Since the signal terminal support section 32, the ground terminal support section 34 and the ground terminal support section 146 are formed as grooves recessed from each surface 20, 22, the signal terminal 16, the ground terminal 18 and the ground terminal 144 are insulated from each other on each surface 20, 22.

Further, on each of the first and second surfaces 20, 22 of the body 142, the signal line connection part 40 of the signal terminal 16 and the shield line connection part 46 of the ground terminal 18 are substantially aligned with respect to the cable support section 36, along the longitudinal direction of the signal terminal 16 and the ground terminal 18 (FIG. 16). According to this configuration, it is possible to attach the module 140 to the coaxial cable 12 in a state where a predetermined cable-end length including the shield line 28, the insulator 26 and the signal line 24 exposed in a stepwise fashion adjacent to the distal end of the coaxial cable 12 extends straight (FIG. 19). Each of the first and second surfaces 20, 22 of the body 142 is provided with a pair of walls 154 at a location between the region 32*b* of the signal terminal support section 32 (FIG. 18) and the region 34*b* of the ground terminal support section 34 (FIG. 18), the walls 154 retaining the signal lines 24 exposed in a straight form at the distal end of the coaxial cable 12 to be positioned parallel to the center axis 142*a* (FIG. 19).

As described above, in the module 140, the single first signal terminal 16, the single first ground terminal 144 with the first ground contact face 148*a* arranged in parallel with the first signal contact face 38*a* of the first signal terminal 16 at one side of the first signal contact face 38*a*, and the single third ground terminal 18 with the third ground contact face 44*a* arranged in parallel with the first signal contact face 38*a* of the first signal terminal 16 at the other side of the first signal contact face 38*a*, are provided on the first surface 20 of the body 142 in such a manner that the first signal contact face 38*a*, the first ground contact face 148*a* and the third ground contact face 44*a* are arranged in parallel with each other with the predetermined pitch P defined therebetween; and the single second signal terminal 16, the single second ground terminal 144 with the second ground contact face 148*a* arranged in parallel with the second signal contact face 38*a* of the second signal terminal 16 at one side of the second signal contact face 38*a*, and the single fourth ground terminal 18 with the fourth ground contact face 44*a* arranged in parallel with the second signal contact face 38*a* of the second signal terminal 16 at the other side of the second signal contact face 38*a*, are provided on the second surface 22 of the body 142 in such a manner that the second signal contact face 38*a*, the second ground contact face 148*a* and the fourth ground contact face 44*a* are arranged in parallel with each other with the pitch P defined therebetween in the same way as the first surface 20. The relative positional relationship between the signal terminal 16, the ground terminal 144 and the ground terminal 18 on the first surface 20 is the same as the relative positional relationship between the signal terminal 16, the ground terminal 144 and the ground terminal 18 on the second surface 22 (FIGS. 16 and 19). Thus, the first signal contact face 38*a* (or the signal contact part 38) arranged on the first surface 20 is located opposite to the second ground contact face 148*a* (or the ground contact part 148) arranged on the second surface 22, and the first ground contact face 148*a* (or the ground contact part 148) arranged on the first surface 20 is located opposite to the second signal contact face 38*a* (or the signal contact part 38) arranged on the second surface 22.

In the module 140, a region with no terminal is formed on the second surface 22 at a location opposite to the third ground contact face 44*a* (or the ground contact part 44) on the first surface 20. In the same way, a region with no terminal is formed on the first surface 20 at a location opposite to the fourth ground contact face 44*a* (or the ground contact part 44) on the second surface 20. Therefore, each surface 20, 22 of the body 142 has a transverse dimension allowing the single signal contact face 38*a*, the single ground contact face 148*a* and double ground contact faces 44*a* to be arranged in parallel with each other. If the dimension of the signal contact face 38*a* and the dimension of each of the ground contact faces 148*a*, 44*a* in the module 140 are the same as the dimension of the signal contact face 38*a* and the dimension of the ground contact face 44*a* in the module 10, the transverse dimension of the body 142 is about two times the transverse dimension of the body 14.

The module 140 is attached to the coaxial cable 12 in a manner as described below. First, the distal end length of the single first coaxial cable 12, which has been subjected to the aforementioned terminal treatment, is put in the first surface 20 of the body 142 through the first cable support section 36 and is moved ahead along the center axis 142*a* with the exposed signal line 24 facing forward (FIG. 17). The signal line 24 exposed in the distal end length of the coaxial cable 12 passes through the shield line connection part 46 of the third ground terminal 18, is inserted between the pair of walls 154 provided on the first surface 20, and is placed in contact with the joint face 40*a* of the signal line connection part 40 of the first signal terminal 16. Along with this insertion operation, the shield line 28 exposed in the distal end length of the coaxial cable 12 is inserted into the shield line connection part 46 of the third ground terminal 18, is placed in contact with the joint face 46*c*, and is disposed adjacent to the shield line connection part 150 of the first ground terminal 144. In this state, the signal line 24 is joined to the joint face 40*a* of the signal line connection part 40 and the shield line 28 is joined to the joint face 46*c* of the shield line connection part 46 and the shield line connection part 150 adjacent thereto, through, e.g., soldering. Thus, the single first coaxial cable 12 is connected to the first signal terminal 16, the first ground terminal 144 and the third ground terminal 18, which are mounted on the first surface 20 of the body 142. In addition, the distal end length of the single second coaxial cable 12, which has been subjected to the aforementioned terminal treatment, is connected, through the same procedure as the above-described procedure, to the second signal terminal 16, the second ground terminal 144 and the fourth ground terminal 18, which are mounted on the second surface 22 of the body 142 (FIG. 19). In this way, the single module 140 is attached to the distal ends of a pair of coaxial cables 12.

The first and second coaxial cables 12, to which the module 140 is attached, are supported at mutually corresponding positions on the first and second surfaces 20, 22 of the body 142 (or positions rotationally symmetrical through 180 degrees with respect to each other about the center axis 142*a* of body 142), with the distal end lengths of the respective coaxial cables extended straight. In this state, the signal line 24 of each of the first and second coaxial cables 12 is held between the pair of walls 154 formed on each surface 20, 22, so as to be positioned to be deviated to one side from the center axis 142*a* of the body 142, and is placed in contact with the joint face 40*a* of the signal line connection part 40 of each of the first and second signal terminals 16. Further, the shield line 28 of each of the first and second coaxial cables 12 is positioned to be deviated to one side from the center axis 142*a* of the body 142, and is placed in contact with the joint face 46*c* of the shield line connection part 46 of each of the third and fourth ground terminals 18.

The module 140 having the aforementioned configuration can exhibit various effects analogous to those exhibited in the module 10. More specifically, it is possible to collectively connect a pair of coaxial cables 12 arranged on the first and second surfaces 20, 22 of the body 142 to a connection counterpart (not depicted) by using the single module 140, so that, when the module 140 is applied to a multipole configuration as explained later, it is possible to prevent the dimensions of a multipole connector from increasing, and to increase the number of cables capable of being connected through the multipole connector. Further in the module 140, the second ground contact face 148*a* is located opposite to the first signal contact face 38*a* and the second signal contact face 38*a* is located opposite to the first ground contact face 148*a*, so that it is possible to easily establish a transmission line configuration wherein a plurality of ground contact parts 148 each having the ground contact face 148*a* surround the single signal contact part 38 having the signal contact face 38*a*, by, e.g., arranging a plurality of modules 140 in parallel with each other in a matrix form. Thus, according to the module 140, when applied to a multipole configuration as explained later, it is possible to prevent the high-frequency transmission characteristics of each coaxial cable 12 from degrading, and to increase the number of cables capable of being connected through a multipole connector.

Further, in the module 140 having the aforementioned configuration, the first and second surfaces 20, 22 of the body 142 have mutually identical configurations and are formed at locations rotationally symmetrical through 180 degrees with respect to each other about the center axis 142*a* of the body 142. Therefore, the arrangement of the first signal contact face 38*a*, the first ground contact face 148*a* and the third ground contact face 44*a* on the first surface 20 has a rotationally symmetrical relationship, through 180 degrees about the center axis 142*a*, to the arrangement of the second signal contact face 38*a*, the second ground contact face 148*a* and the fourth ground contact face 44*a* on the second surface 22. According to this configuration, it is possible to connect the module 140 to the connection counterpart regardless of the directionality of the first and second surfaces 20, 22 of the body 142.

Further, in the module 140 having the aforementioned configuration, the shape of the first signal terminal 16 is identical to the shape of the second signal terminal 16, the shape of the first ground terminal 144 is identical to the shape of the second ground terminal 144, and the shape of the third ground terminal 18 is identical to the shape of the fourth ground terminal 18. According to this configuration, it is possible to reduce the components of different types in the module 140. On the other hand, the first ground terminal 144 and the third ground terminal 18 have mutually different shapes and are electrically connected with each other on the first surface 20, and the second ground terminal 144 and the fourth ground terminal 18 have mutually different shapes and are electrically connected with each other on the second surface 22. According to this configuration, it is possible to simplify the shapes of the first and second ground terminal 144, and thus to easily arrange, on each surface 20, 22, the unipotential pair of ground contact faces 148*a*, 44*a* at the left and right sides of the single signal contact face 38*a*.

Further, in the module 140 having the aforementioned configuration, the body 142 is provided, on the first surface 20, with the first cable support section 36 for supporting the first coaxial cable 12 (or the sheathed portion thereof) and, on the second surface 22, with the second cable support section 36 for supporting the second coaxial cable 12 (or the sheathed portion thereof). According to this configuration, it is possible to stably hold the distal end length of each coaxial cable 12 on the body 142. Further, the first cable support section 36 is displaced relative to the second cable support section 36 in the direction of the spaces or pitch P between the signal contact face 38*a* and the ground contact faces 148*a*, 44*a* (i.e., the transverse direction of the body 142) (FIG. 17). According to this configuration, it is possible to connect a coaxial cable 12 to the module 140, which has a diameter larger than that of a coaxial cable 12 to which the module 10 is attached, while maintaining the vertical dimension of the module 140 substantially equal to the module 10.

In order to permit a coaxial cable 12, having a diameter larger than that of a coaxial cable 12 to which the module 10 is attached, to be connected to the module 140 while maintaining the vertical dimension thereof substantially equal to the module 10, the module 140 is configured so that the first cable support section 36 and the second cable support section 36 are arranged to be displaced relative to each other in the direction of the pitch P as explained above, and the first signal contact face 38*a* and the third ground contact face 44*a*, as well as the second signal contact face 38*a* and the fourth ground contact face 44*a*, are arranged respectively on the first and second surfaces 20, 22 to be deviated to one side from the center axis 142*a* of the body 142. Also in this configuration, since the unipotential pair of ground contact faces 148*a*, 44*a* are arranged at the left and right sides of the single signal contact face 38*a*, it is possible to uniformize the distances between the signal lines and the ground lines on each surface 20, 22, and thereby to ensure impedance matching.

Further, in the module 140 having the aforementioned configuration, the first signal terminal 16 includes the signal line connection part 40 adapted to be connected to the signal line 24 of the first coaxial cable 12, the third ground terminal 18 includes the shield line connection part 46 adapted to be connected to the shield line 28 of the first coaxial cable 12, and, on the first surface 20 of the body 142, the signal line connection part 40, the shield line connection part 46 and the first cable support section 36 are aligned with each other along the longitudinal direction of the first signal terminal 16 and the third ground terminal 18. Also, the second signal terminal 16 includes the signal line connection part 40 adapted to be connected to the signal line 24 of the second coaxial cable 12, the fourth ground terminal 18 includes the shield line connection part 46 adapted to be connected to the shield line 28 of the second coaxial cable 12, and, on the second surface 22 of the body 142, the signal line connection part 40, the shield line connection part 46 and the second cable support section 36 are aligned with each other along the longitudinal direction of the second signal terminal 16 and the fourth ground terminal 18. According to this configuration, it is possible to attach the module 140 to the first and second coaxial cables 12 in a state where the distal end length of each coaxial cable 12 extends straight, and thus possible to reduce the dimensions of the body 142, in particular the transverse dimension.

As will be understood from the above description, the module 140 can be fabricated from the minimum number of simple components (i.e., the body 142, the signal terminals 16, the ground terminals 144, and the ground terminals 18), the signal terminal 16, the ground terminal 144 and the ground terminal 18 can be stably connected to the signal line 24 and the shield line 28 of the coaxial cable 12 by a simple work, and the module 140 can be applied not only to a multipole configuration but also a high-density configuration, due to the reduction in the dimensions of the body 142, in particular the transverse dimension.

Figure 20:
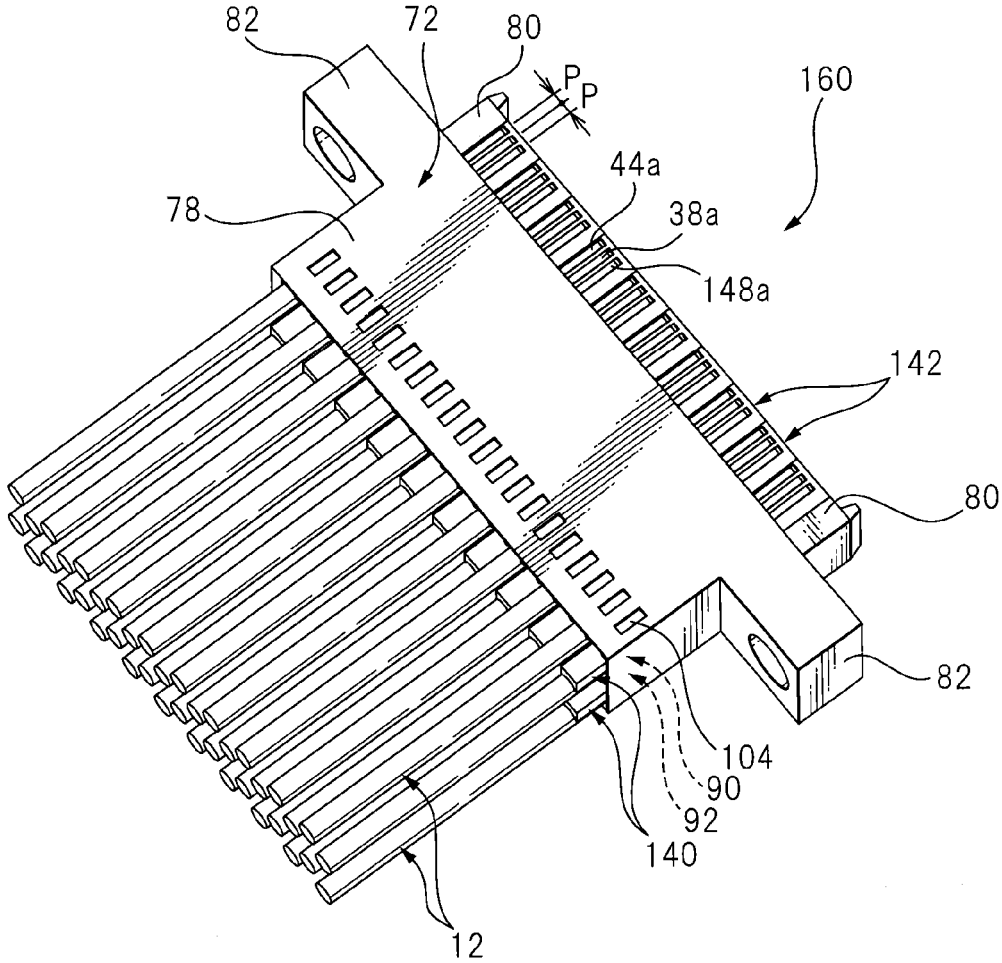
FIG. 20 is a perspective view depicting a multipole connector for a coaxial cable, according to another embodiment of the present invention, with a plurality of coaxial cables connected thereto.
Figure 21:
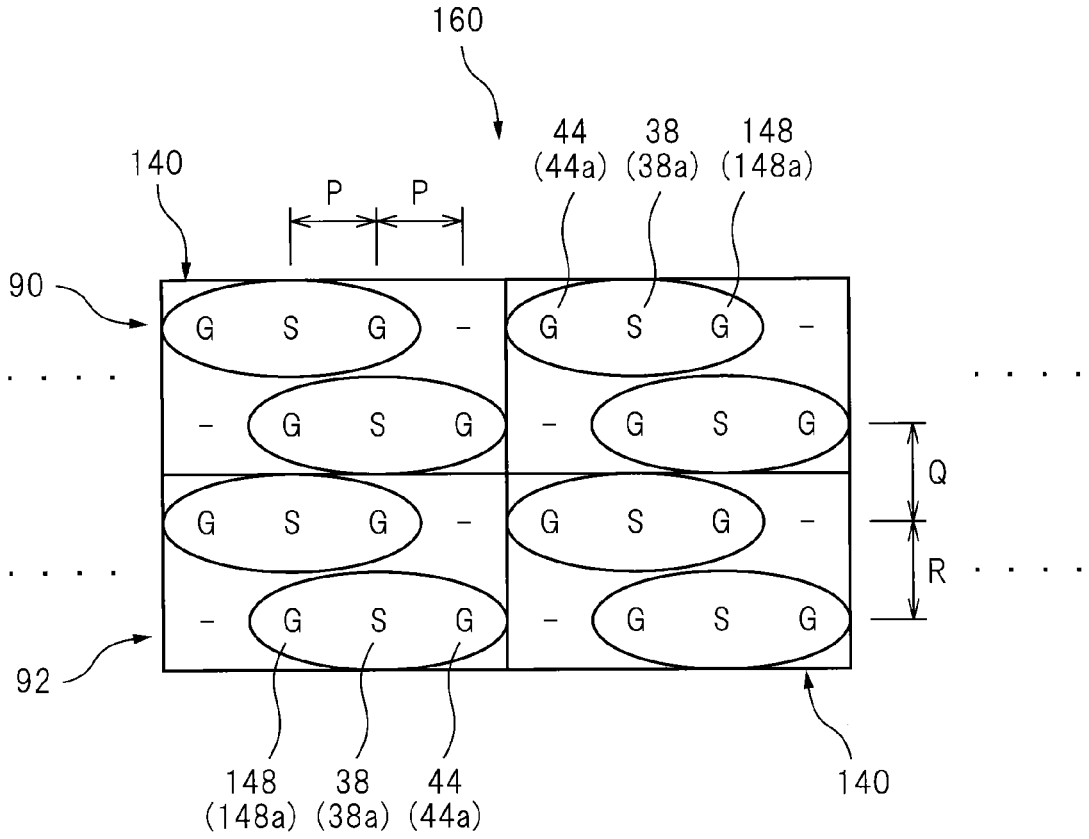
FIG. 21 is an illustration diagrammatically depicting a transmission line configured in the multipole connector of FIG. 20.

The module 140 may constitute a coaxial cable connector adapted to mate with a counterpart connector, by fitting a single module 140 to a housing. Alternatively, the module 140 may constitute a multipole connector for a coaxial cable, by assembling a plurality of modules 140 in a single housing. Referring now to FIGS. 20 and 21, the configuration of a multipole connector 70 for a coaxial cable, according to another embodiment, will be explained below.

As depicted in FIG. 20, the multipole connector 160 for a coaxial cable (hereinafter referred simply to as "multipole connector 160") includes a plurality of modules 140 and a housing 72 receiving and supporting the modules 140 in a parallel arrangement. The housing 72 has a configuration identical to that of the housing 72 of the aforementioned multipole connector 70. Therefore, in the multipole connector 160, a set of predetermined number of modules 140 are received and supported in a parallel arrangement in each of the first module support section 90 and the second module support section 92 of the housing 72 (FIG. 20). In each of the first and second module support sections 90, 92, the first signal contact faces 38*a*, the first ground contact faces 148*a* and the third ground contact faces 44*a*, each of which is arranged on the first surface 20 of the body 142 of each module 140, are alternately arranged in parallel with each other with the predetermined pitch P maintained uniformly throughout except for the region with no terminal, and that the second signal contact faces 38*a*, the second ground contact faces 148*a* and the fourth ground contact faces 44*a*, each of which is arranged on the second surface 20 of the bnody 142, are alternately arranged in parallel with each other with the predetermined pitch P maintained uniformly throughout except for the region with no terminal.

FIG. 21 diagrammatically depicts a transmission line configured by the signal contact faces 38*a* (or the signal contact parts 38), the ground contact faces 148*a* (or the ground contact parts 148) and the ground contact faces 44*a* (or the ground contact parts 44) of the plurality of modules 140 provided in the multipole connector 160. As illustrated, the plurality of modules 140 are supported in the respective module support sections 90, 92 and thus are arranged in parallel with each other in a matrix form in the housing 72, so that it is possible to establish a transmission line configuration wherein the plurality of ground contact parts 148, 44, each having the ground contact face 148*a*, 44*a*, surround the single signal contact part 38 having the signal contact face 38*a*. The illustrated transmission line configuration is capable of reducing a crosstalk between signal lines, and also effectively reducing transmission loss, such as attenuation or reflection of signals. Note, in the illustrated configuration, the pitch P determined for the signal contact faces 38*a*, the ground contact faces 148*a* and the ground contact faces 44*a* in the longitudinal direction of the housing body part of the multipole connector 160 is different from pitches Q, R determined for the signal contact faces 38*a*, the ground contact faces 148*a* and the ground contact faces 44*a* in the vertical direction of the housing body part of the multipole connector 160. The pitches Q, R are respectively determined by the vertical dimension (or thickness) of the partition wall 94 of the housing 72 and the vertical dimension (or thickness) of the body 142 of each module 140. Therefore, also in the vertical direction of the multipole connector 160, it is possible to arrange the signal contact faces 38*a*, the ground contact faces 148*a* and the ground contact faces 44*a* with the pitch P defined therebetween, by suitably adjusting the thicknesses of the partition wall 94 and the body 142.

The multipole connector 160 having the aforementioned configuration can exhibit various effects analogous to those exhibited in the multipole connector 70. More specifically, a plurality of modules 140 are received in the housing 72 in a parallel arrangement, so that it is possible to prevent the dimensions of the multipole connector 160 from increasing, to prevent the high-frequency transmission characteristics of each coaxial cable 12 from degrading, and to increase the number of cables capable of being connected through the multipole connector 160. In particular, in the multipole connector 160, it is possible to establish a multipole connector configuration fixedly attached to the distal ends of the coaxial cables 12, through an extremely simple work such that a predetermined number of modules 140, each of which is connected to a pair of coaxial cables 12, are inserted into the module support sections 90, 92 of the housing 72.

Further, the plurality of modules 140 supported in the housing 72 are configured so that the signal contact faces 38*a*, the ground contact faces 148*a* and the ground contact faces 44*a*, each of which is arranged on each of the first and second surfaces 20, 22 of the body 142, are alternately arranged in parallel with each other with the predetermined pitch P maintained uniformly throughout except for the region with no terminal, and therefore, in the transmission line configuration wherein the plurality of ground contact parts 148, 44 surround the single signal contact part 38, it is possible to uniformize the distances between the signal lines and the ground lines and thereby to ensure impedance matching. In the configuration that the housing 72 includes the two-tiered module support sections 90, 92, it is also possible to surround the single signal contact part 38 (or the signal contact face 38*a*) by the plurality of ground contact parts 148 (or the ground contact faces 148*a*) in the vertical direction. In particular, even in the configuration wherein the coaxial cable 12 having a diameter larger than that of a coaxial cable 12 to which the module 10 is attached is connected to the module 140, it is possible to constitute the multipole connector 160 by using the housing 72 having the same dimensions as the housing 72 of the multipole connector 70. Note, the number of the modules 140 supported in each module support section 90, 92 is not particularly limited. Also, the number of tiers of the module support sections is not limited to two, but may be one or at least three. The number of the modules 140 provided in the multipole connector 160 may be suitably set in accordance application requirement.

In a manner analogous to the multipole connector 70, the multipole connector 160 may be structurally integrated with a low speed connector 112, so as to constitute a multipole composite connector. Such a multipole composite connector is capable of simplifying a mounting work or a mating work, in comparison with a configuration using a multipole connector for a coaxial cable and another connector for a non-coaxial cable separated from the multipole connector, similar to the multipole composite connector 110, and also due to the provision of the multipole connector 160, capable of exhibiting various effects relating to high frequency transmission, which are also exhibited by the multipole connector 160.

While the invention has been described with reference to specific embodiments, it will be understood by those skilled in the art that various changes and modifications may be made thereto without departing from the scope of the following claims.

The invention claimed is:

1. A coaxial cable connection module comprising:

a body having electrical insulating properties, the body including a first surface and a second surface opposite to the first surface;

a first signal terminal provided on said first surface and adapted to be connected to a signal line of a first coaxial cable, the first signal terminal including a first flat signal contact face adapted to contact a signal conductor of a connection counterpart;

a first ground terminal provided on said first surface and adapted to be connected to a shield line of the first coaxial cable, the first ground terminal including a first flat ground contact face adapted to contact a ground conductor of a connection counterpart;

a second signal terminal provided on said second surface and adapted to be connected to a signal line of a second coaxial cable, the second signal terminal including a second flat signal contact face adapted to contact a signal conductor of a connection counterpart; and a second ground terminal provided on said second surface and adapted to be connected to a shield line of the second coaxial cable, the second ground terminal including a second flat ground contact face adapted to contact a ground conductor of a connection counterpart;

wherein said first signal contact face and said first ground contact face are arranged, on said first surface, in parallel with each other;

wherein said second signal contact face and said second ground contact face are arranged, on said second surface, in parallel with each other;

wherein said first signal contact face is located opposite to said second ground contact face, and said first ground contact face is located opposite to said second signal contact face.

2. The coaxial cable connection module of claim 1, wherein an arrangement of said first signal contact face and said first ground contact face on said first surface has a rotationally symmetrical relationship to an arrangement of said second signal contact face and said second ground contact face on said second surface.

3. The coaxial cable connection module of claim 1, wherein a single first signal contact face and a single first ground contact face are arranged on said first surface; and wherein a single second signal contact face and a single second ground contact face are arranged on said second surface.

4. The coaxial cable connection module of claim 1, wherein said body is provided, on said first surface, with a first cable support section for supporting the first coaxial cable and, on said second surface, with a second cable support section for supporting the second coaxial cable;

wherein said first signal terminal includes a signal line connection part adapted to be connected to the signal line of the first coaxial cable; said first ground terminal includes a shield line connection part adapted to be connected to the shield line of the first coaxial cable; and, on said first surface, said signal line connection part, said shield line connection part and said first cable support section are aligned with each other along a longitudinal direction of said first signal terminal and said first ground terminal; and wherein said second signal terminal includes a signal line connection part adapted to be connected to the signal line of the second coaxial cable; said second ground terminal includes a shield line connection part adapted to be connected to the shield line of the second coaxial cable; and, on said second surface, said signal line connection part, said shield line connection part and said second cable support section are aligned with each other along a longitudinal direction of said second signal terminal and said second ground terminal.

5. The coaxial cable connection module of claim 1, further comprising:

a third ground terminal provided on said first surface and adapted to be connected to the shield line of the first coaxial cable, the third ground terminal including a third flat ground contact face adapted to contact a ground conductor of a connection counterpart; and a fourth ground terminal provided on said second surface and adapted to be connected to the shield line of the second coaxial cable, the fourth ground terminal including a fourth flat ground contact face adapted to contact a ground conductor of a connection counterpart;

wherein said third ground contact face is arranged, on said first surface, in parallel with said first signal contact face at a side opposite to said first ground contact face with equal spaces defined therebetween; and wherein said fourth ground contact face is arranged, on said second surface, in parallel with said second signal contact face at a side opposite to said second ground contact face with equal spaces defined therebetween.

6. The coaxial cable connection module of claim 5, wherein said body is provided, on said first surface, with a first cable support section for supporting the first coaxial cable and, on said second surface, with a second cable support section for supporting the second coaxial cable, said first cable support section being displaced relative to said second cable support section in a direction of said spaces.

7. A multipole connector for a coaxial cable, the multipole connector comprising:

a plurality of coaxial cable connection modules; and a housing receiving and supporting said plurality of coaxial cable connection modules in a parallel arrangement, each of said plurality of coaxial cable connection modules comprising:

a body having electrical insulating properties, the body including a first surface and a second surface opposite to the first surface;

a first signal terminal provided on said first surface and adapted to be connected to a signal line of a first coaxial cable, the first signal terminal including a first flat signal contact face adapted to contact a signal conductor of a connection counterpart;

a first ground terminal provided on said first surface and adapted to be connected to a shield line of the first coaxial cable, the first ground terminal including a first flat ground contact face adapted to contact a ground conductor of a connection counterpart;

a second signal terminal provided on said second surface and adapted to be connected to a signal line of a second coaxial cable, the second signal terminal including a second flat signal contact face adapted to contact a signal conductor of a connection counterpart; and a second ground terminal provided on said second surface and adapted to be connected to a shield line of the second coaxial cable, the second ground terminal including a second flat ground contact face adapted to contact a ground conductor of a connection counterpart;

wherein said first signal contact face and said first ground contact face are arranged, on said first surface, in parallel with each other;

wherein said second signal contact face and said second ground contact face are arranged, on said second surface, in parallel with each other;

wherein said first signal contact face is located opposite to said second ground contact face, and said first ground contact face is located opposite to said second signal contact face.

8. The multipole connector of claim 7, wherein said plurality of coaxial cable connection modules supported on said housing are configured so that signal contact faces and ground contact faces, each of which is arranged on said first surface of said body, are alternately arranged in parallel with each other, and that signal contact faces and ground contact faces, each of which is arranged on said second surface of said body, are alternately arranged in parallel with each other.

9. The multipole connector of claim 7, wherein said housing is provided with a first module support section receiving and supporting a set of said plurality of coaxial cable connection modules in a parallel arrangement and a second module support section provided parallel to said first module support section in a tiered manner and receiving and supporting another set of said plurality of coaxial cable connection modules in a parallel arrangement.

10. A multipole composite connector comprising:

a multipole connector; and a connector for a non-coaxial cable combined with said multipole connector in a unitary manner, said multipole connector comprising:

a plurality of coaxial cable connection modules; and a housing receiving and supporting said plurality of coaxial cable connection modules in a parallel arrangement, each of said plurality of coaxial cable connection modules comprising:

a body having electrical insulating properties, the body including a first surface and a second surface opposite to the first surface;

a first signal terminal provided on said first surface and adapted to be connected to a signal line of a first coaxial cable, the first signal terminal including a first flat signal contact face adapted to contact a signal conductor of a connection counterpart;

a first ground terminal provided on said first surface and adapted to be connected to a shield line of the first coaxial cable, the first ground terminal including a first flat ground contact face adapted to contact a ground conductor of a connection counterpart;

a second signal terminal provided on said second surface and adapted to be connected to a signal line of a second coaxial cable, the second signal terminal including a second flat signal contact face adapted to contact a signal conductor of a connection counterpart; and a second ground terminal provided on said second surface and adapted to be connected to a shield line of the second coaxial cable, the second ground terminal including a second flat ground contact face adapted to contact a ground conductor of a connection counterpart;

wherein said first signal contact face and said first ground contact face are arranged, on said first surface, in parallel with each other;

wherein said second signal contact face and said second ground contact face are arranged, on said second surface, in parallel with each other;

wherein said first signal contact face is located opposite to said second ground contact face, and said first ground contact face is located opposite to said second signal contact face.

* * * * *